US008128304B2

(12) United States Patent
Kurita et al.

(10) Patent No.: US 8,128,304 B2
(45) Date of Patent: Mar. 6, 2012

(54) DIRECT-FLUID-SUPPLY WRITING IMPLEMENT

(75) Inventors: Tetsuhiro Kurita, Nagoya (JP); Takao Inaba, Nagoya (JP)

(73) Assignee: The Pilot Ink Co., Ltd., Aichi (JP)

( * ) Notice: Subject to any disclaimer, the term of this patent is extended or adjusted under 35 U.S.C. 154(b) by 1397 days.

(21) Appl. No.: 11/715,946

(22) Filed: Mar. 9, 2007

(65) Prior Publication Data

US 2007/0212159 A1 Sep. 13, 2007

(30) Foreign Application Priority Data

| | | |
|---|---|---|
| Mar. 9, 2006 | (JP) | 2006-63785 |
| Mar. 9, 2006 | (JP) | 2006-63786 |
| Mar. 13, 2006 | (JP) | 2006-68245 |
| Mar. 13, 2006 | (JP) | 2006-68246 |
| Jan. 6, 2007 | (JP) | 2007-00850 |
| Jan. 6, 2007 | (JP) | 2007-00851 |

(51) Int. Cl.
*B43K 5/00* (2006.01)

(52) U.S. Cl. ..... 401/198; 401/223

(58) Field of Classification Search ..... 401/198, 401/199, 223, 224, 225
See application file for complete search history.

(56) References Cited

U.S. PATENT DOCUMENTS

| | | | | |
|---|---|---|---|---|
| 5,454,658 | A | 10/1995 | Kato | |
| 6,086,279 | A * | 7/2000 | Yen | 401/202 |

FOREIGN PATENT DOCUMENTS

| | | | |
|---|---|---|---|
| JP | 45-18890 | | 8/1970 |
| JP | 56-7504 | Y2 | 2/1981 |
| JP | 60-7191 | Y2 | 3/1985 |
| WO | 03/101760 | A | 12/2003 |

* cited by examiner

*Primary Examiner* — David Walczak
(74) *Attorney, Agent, or Firm* — Sughrue Mion, PLLC

(57) ABSTRACT

A direct-fluid-supply writing implement has a pentip, an ink occlusion body connected to a rear end of the pentip, an ink tank that directly stores ink and is arranged at a rear of the ink occlusion body, a plurality of communication tubes that connects the ink tank to the ink occlusion body and a partition wall provided between the ink occlusion body and the ink tank. Forward end portions of the communication tubes are protruded forward from a front face of the partition wall, and are located inside the ink occlusion body. At least one of the communication tubes is provided such that a rear end of the communication tube is protruded backward from a rear face of the partition wall and is located inside the ink tank.

26 Claims, 23 Drawing Sheets

DIRECT-FLUID-SUPPLY WRITING IMPLEMENT

The present invention claims foreign priority to Japanese patent application Nos. JP.2006-63785, filed on Mar. 9, 2006,
JP.2006-63786, filed on Mar. 9, 2006,
JP.2006-68245, filed on Mar. 13, 2006,
JP.2006-68246, filed on Mar. 13, 2006,
JP.2007-850, filed on Jan. 6, 2007, and
JP.2007-851, filed on Jan. 6, 2007,
the contents of which are incorporated herein by reference.

BACKGROUND OF THE INVENTION

1. Field of the Invention

The present invention is related to a direct-fluid-supply writing implement in which ink is stored in an ink tank and an ink occlusion body is interposed between the ink tank and a pentip. In the present invention, "front" is defined as a pentip side and "rear" is defined as an ink tank side.

2. Description of Related Art (1) Concerning this direct-fluid-supply writing implement, for example, Japanese Utility Model Examined Publication JP-UM-Y-45-18890 discloses a writing instrument characterized in that:

an accommodation body, into which an occlusion material is charged, having a communication hole (communication tube) and a through-hole, is inserted into an upper opening portion of an ink receiving body; and a pentip communicating with the occlusion material is provided in the communication tube and inserted into the through-hole so as to communicate the ambient air with the ink receiving body.

Although the direct-fluid-supply writing implement disclosed in JP-UM-Y-45-18890 includes a connection tube and a communication tube in the upper opening portion of the ink receiving body, the communication tube is communicated with the ambient air at all times. Therefore, when the writing instrument is put in a state in which the pentip side is maintained downward, the ambient air is continuously supplied into the ink accommodation body through the communication tube. At the same time, ink is continuously supplied from the ink receiving body to the occlusion material through the communication tube. As a result, there is a possibility that ink leaks out from the ink receiving body to the outside through the pentip side.

(2) Further, Japanese Utility Model Examined Publication JP-UM-Y-56-7504 discloses a felt pen for writing in small characters characterized in that:

an ink accommodation chamber having an ink replenishing port, to which a lid body for tightly sealing is detachably attached, is provided on one side of the inside of a container body;

an ink occlusion material accommodation chamber, which is separate from the ink accommodation chamber by a partition wall, is arranged on a forward end opening portion side of a main body being communicated with the opening portion;

a liquid absorbing material having a ventilation property, which is divided into two portions, is accommodated in the accommodation chamber;

a base portion of a pentip is held by the liquid absorbing material on the forward end opening portion side and an end face of the base portion is contacted with the liquid absorbing material on the ink accommodation chamber side;

a liquid supply hole for supplying liquid to the liquid absorbing material is formed on the partition wall;

an appropriate air supply tube is fixed and one of the end face opening portions of this air supply tube is made to come into contact with the liquid absorbing material on the main body forward end opening portion side; and the other end face opening portion is located in the ink accommodation chamber located close to the ink replenishing port.

The direct-fluid-supply writing implement of JP-UM-Y-56-7504 described above is composed in such a manner that two liquid absorbing materials are provided and a front end face of the air supply tube is made to come into contact with a rear end face of the liquid absorbing material on the main body forward end opening portion side so that the liquid supply hole can be communicated with a rear end face of the liquid absorbing material on the ink accommodation chamber side. That is, the direct-fluid-supply writing implement of JP-UM-Y-56-7504 described above is composed in such a manner that the front end opening portion of the air supply tube and the front end opening portion of the liquid supply hole are located being separate from each other in the front and rear direction. Therefore, it is difficult to close an opening end of the air supply tube by ink which is supplied from the liquid supply hole and impregnated in the liquid absorbing material. That is, it is difficult to put the opening end of the air supply tube into a liquid-sealing state. Accordingly, it is impossible to positively stop an outflow of ink from the ink tank and an inflow of air into the ink tank, that is, it is difficult to positively replace ink with air. As a result, a surplus quantity of ink is supplied to the liquid absorbing material. Accordingly, there is a possibility that ink leaks outside from the pentip side.

Further, since the direct-fluid-supply writing implement of JP-UM-Y-56-7504 is composed in such a manner that the pentip penetrates a liquid absorbing material on the main body forward end opening portion side and comes into contact with the liquid absorbing material on the ink accommodation chamber side. Therefore, it is difficult to set a longitudinal size of the pentip at a short length. Accordingly, a manufacturing cost of the pentip is raised. Therefore, it is impossible to provide the direct-fluid-supply writing implement to a user at a low price. Further, an ink flowing-out passage from the rear end to the front end of the pentip is extended and an ink outflow property is deteriorated. Accordingly, handwriting becomes blurred. Further, handwriting tends to break.

(3) Furthermore, Japanese Utility Model Examined Publication discloses a brush type writing instrument characterized in that:

an ink adjusting tube and an ink guiding tube are concentrically arranged in a front shaft;

an intermediate core is inserted into the ink guiding tube;

a rear end of the intermediate core is inserted into an ink chamber (ink tank) and a front end is located at a rear end of the brush body while a predetermined gap is being formed;

an ink absorbing body made of porous material is attached to an annular passage between the ink adjusting tube and the ink guiding tube and on a rear end of the brush body;

density of the forward end is made to be higher than that of the other portions;

an ink passage is formed at the rear end of the brush body;

an air passage communicated with the ambient air is formed between an inner face of the front shaft and an outer face of the ink adjusting tube; and a rear end of the air passage and a rear end of the ink adjusting tube are communicated with each other.

The direct-fluid-supply writing implement of JP-UM-Y-60-7191 described above is composed in such a manner that the ink tank and the ink absorbing body are connected with each other by only one ink guiding tube. Therefore, at the time of the initial supply of ink, that is, at the time of supplying ink from the ink tank to the liquid absorbing material for the first time, air and ink can not be quickly replaced with each other. Accordingly, it takes a pretty long period of time until the writing instrument gets ready for writing.

Further, since the number of parts of the direct-fluid-supply writing implement of JP-UM-Y-60-7191 is large and the structure is complicated, it is difficult to provide the direct-fluid-supply writing implement of JP-UM-Y-60-7191 to a user at a low price.

SUMMARY OF THE INVENTION

The present invention has been accomplished to solve the above conventional problems. It is an object of the present invention to provide a direct-fluid-supply writing implement in which there is no possibility that ink leaks out from an ink tank through a pentip side;

a longitudinal length of the pentip is reduced so that a manufacturing cost of the pentip can be suppressed and ink can smoothly flow out from the pentip;

air and ink is quickly replaced with each other at the initial stage of supplying ink, so that writing can be started in a short period of time;

a structure can be simplified; and even when pressure in an ink tank is suddenly changed, a leakage or a blowup of ink can be prevented.

According to a first aspect of the present invention, there is provided a direct-fluid-supply writing implement comprising:

a pentip;

an ink occlusion body connected to a rear end of the pentip;

an ink tank that directly stores ink and is arranged at a rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, and at least one of the communication tubes is provided such that a rear end of the communication tube is protruded backward from a rear face of the partition wall and is located inside the ink tank.

According to the first aspect of the invention, a rear end portion of the communication tube 6*b* protruding backward from a rear face of the partition wall 52 is located above the ink level in one case and located below the ink level (that is in ink) in another case according to a direction of the pentip 2 or a quantity of residual ink in the ink tank 7. In a state in which a rear end portion of the communication tube 6*b* protruded backward from the rear face of the partition wall 52 is located above the ink level, air flows between the ink tank 7 and the ambient air by the communication tube 6*b* protruded backward, and ink flows between the ink tank 7 and the ink occlusion body 3 by the other communication tube 6*a*. On the other hand, in a state in which the rear end of the communication tube 6*b* protruded backward from the rear face of the partition wall 52 is located below the ink level, air flows between the ink tank 7 and the ambient air by at least one communication tube 6, and ink flows between the ink tank 7 and the ink occlusion body 3 by the other communication tube 6.

When ink is supplied from the ink tank 7 into the occlusion body 3 in the direct-fluid-supply writing implement according to the first aspect of the invention, the pentip 2 is directed downward. Then, ink is supplied from the ink tank 7 into the ink occlusion body 3 through at least one communication tube 6 by gravity. Therefore, ink is impregnated in the ink occlusion body 3. At the same time, the ambient air passes through the other communication tube 6 and taken into the ink tank 7. When a predetermined quantity of ink is impregnated in the ink occlusion body 3, a forward end opening portion of the other communication tube 6, which has been taking in the ambient air, is sealed with the impregnated ink and temporarily closed. Therefore, the supply of the outside into the ink tank 7 is stopped. At the same time, the ink supply from the ink tank 7 into the ink occlusion body 3 conducted by the communication tube 6, which has been supplying ink, is also stopped. As a result, the front end opening portions of the communication tubes 6 are put into a liquid-sealing state and temporarily closed. Accordingly, an outflow of ink from the ink tank 7 and an inflow of air into the ink tank 7 are stopped, that is, a replacement of ink and air is stopped.

In the direct-fluid-supply writing implement 1 according to the first aspect of the invention, front end portions of the communication tubes 6 are located in the ink occlusion body 3. Therefore, all the front end opening portions of the communication tubes 6 can be easily sealed by the liquid seal of ink which is impregnated in the ink occlusion body 3. As a result, no surplus ink is supplied from the ink tank 7 to the ink occlusion body 3. Accordingly, there is no possibility that ink leaks outside from the pentip 2 side.

Since the direct-fluid-supply writing implement 1 according to the first aspect of the invention, includes plurality of the communication tubes 6, that is two or more, when at least one communication tube 6 supplies ink, the other communication tubes 6 supply air. Therefore, at the initial state of supplying ink, that is, in the case where ink is first supplied to the ink occlusion body 3 which is not impregnated with ink, ink and air can be quickly replaced with each other. Accordingly, it becomes possible to start writing in a short period of time.

In the direct-fluid-supply writing implement 1 according to the first aspect of the invention, in the case where pressure in the ink tank 7 is raised by a rise in the temperature, surplus ink, which has been pushed out from the ink tank 7, passes through the communication tube 6 and is supplied into the ink occlusion body 3 and temporarily impregnated inside the ink occlusion body 3. On the other hand, in the case where pressure in the ink tank 7 is lowered by a decrease in temperature, ink impregnated inside the ink occlusion body 3 is returned into the ink tank 7 through the communication tubes 6. Due to the foregoing, in the case where pressure in the ink tank 7 is changed, surplus ink in the ink tank 7 can be appropriately absorbed in the ink occlusion body 3 and then appropriately returned into the ink tank 7. As a result, it is possible to sufficiently prevent ink from leaking outside.

In the direct-fluid-supply writing implement 1 according to the first aspect of the invention, at least one communication tube 6*b* is protruded backward from the rear face of the partition wall 52 and a rear end portion of the communication tube 6*b* is located inside the ink tank 7. Due to the above structure, in the case where a sudden pressure change is caused in a state in which the pentip is directed downward, pressurized air in the ink tank 7 flows into a rear end opening portion of the communication tube 6*b* protruded backward from the rear face of the partition wall 52 and passes in the communication tube 6*b* and then passes in the ink occlusion body 3 and quickly discharges outside. Accordingly, there is no possibility that ink leaks out or blows up from the pentip 2 side. That is, according to the direct-fluid-supply writing implement 1 according to the first aspect of the invention, even if a sudden pressure change is caused in the ink tank 7 in a state in which the pentip is directed downward, it is possible to prevent ink from leaking out or blowing up from the pentip 2 side.

Especially when the pentip is directed downward, even if the rear end portion of the communication tube 6*b* protruded backward is not located above the ink level, a distance from the ink level to the rear end portion of the communication tube 6*b* protruded backward is smaller than a distance from the ink level to the rear face of the partition wall 52, that is, a distance from the rear end portion of the communication tube 6*a* not protruded backward from the rear face of the partition wall 52 to the ink level. Therefore, even when pressure in the ink tank is suddenly changed, a large quantity of ink is not pushed out from the ink tank 7 into the ink occlusion body 3 and only a small quantity of surplus ink is pushed out from the ink tank 7 into the ink occlusion body 3 through the communication tubes 6 and held in the ink occlusion body 3. Instantly after that, the rear end opening portion of the communication tube 6*b* protruded backward and a space formed above the ink level are communicated with each other. Therefore, pressurized air above the ink level passes through the communication tubes 6*b* protruded backward and discharges outside. Due to the foregoing, even when a sudden pressure change is caused in a state in which the pentip is directed downward, it is possible to sufficiently prevent ink from leaking out or blowing up from the pentip 2 side.

In this connection, the case in which pressure in the ink tank 7 is suddenly changed is explained as follows. For example, it is a case in which after a cap has been attached onto the pentip side in an environment of low temperature, air in the ink tank 7 is pressurized in an environment of high temperature and the cap is detached from the pentip side. Alternatively, it is a case in which after the cap has been attached onto the pentip side in one normal atmospheric pressure, the cap is detached from the pentip side while air in the ink tank 7 is being pressurized in a decompression state, for example, in an airplane.

According to a second aspect of the invention, as set forth in the first aspect of the invention, it is preferable that positions of the forward end portions of the communication tubes in the axial direction are set equally to each other.

In the above direct-fluid-supply writing implement 1 according to the second aspect of the invention, positions of the forward end portions of the communication tubes 6 in the axial direction are set equally to each other. That is, front end portions of the communication tubes 6 are not separate from each other in the longitudinal direction. Therefore, distances between the front end portions of the communication tubes 6 inside the ink occlusion body 3 are further reduced. Accordingly, a liquid sealing property of the front end opening portions of the communication tubes 6 can be enhanced. Therefore, it is possible to further prevent ink from leaking outside.

According to a third aspect of the invention, as set forth in the first aspect of the invention, it is preferable that the forward end portions of the communication tubes are located at positions close to the rear end portion of the pentip in the ink occlusion body.

In the direct-fluid-supply writing implement 1 according to the third aspect of the invention, forward end portions of the communication tubes 6 are located at positions close to a rear end portion of the pentip 2. Due to the above structure, even when ink is supplied from the front end opening portion of any communication tube 6, ink can be quickly supplied to the pentip 2. Therefore, at the initial stage of supplying ink, it becomes possible to start writing in a short period of time.

According to a fourth aspect of the invention, as set forth in the first aspect of the invention, it is preferable that the forward end portions of the communication tubes are located at positions in the front of the inside of the ink occlusion body, and the rear end portion of the pentip is located in a front side of the inside of the ink occlusion body.

In the direct-fluid-supply writing implement 1 as set forth in the fourth aspect of the invention, since the rear end of the pentip 2 is located in the front portion of the inside of the ink occlusion body 3, a longitudinal size of the entire pentip 2 can be reduced. As a result, after an abundant quantity of ink from the ink tank 7 has passed through the communication tubes 6 and has been supplied to the rear end portion of the pentip 2 through the inside of the ink occlusion body 3, ink is quickly supplied to a forward end portion of the pentip 2. Accordingly, ink can smoothly flow out from the pentip 2 under the condition that no handwriting is broken or no handwriting becomes blurred. Since the longitudinal size of the entire pentip 2 can be set at a small size, a manufacturing cost of the pentip 2 can be reduced.

In the direct-fluid-supply writing implement 1 as set forth in the fourth aspect of the invention, in the case where pressure in the ink tank 7 is raised by a rise in the temperature, surplus ink, which has been pushed out from the ink tank 7, passes through the communication tube 6 and is supplied into a front portion of the inside of the ink occlusion body 3 and after that, the ink is supplied into a rear portion of the inside of the ink occlusion body 3, then temporarily impregnated inside the ink occlusion body 3. On the other hand, in the case where pressure in the ink tank 7 is lowered by a decrease in temperature, ink impregnated at the rear of the inside the ink occlusion body 3 is returned from the front portion of the ink occlusion body 3 into the ink tank 7 through the communication tubes 6.

According to the direct-fluid-supply writing implement 1 as set forth in the fourth aspect of the invention, front end portions of the communication tubes 6 are located in the front portion inside the ink occlusion body 3. Due to the above structure, when pressure in the ink tank 7 is changed, surplus ink in the ink tank 7 is appropriately absorbed into the ink occlusion body 3. After that, this surplus ink can be appropriately returned into the ink tank 7. As a result, ink can be prevented from leaking outside.

According to a fifth aspect of the invention, as set forth in the first aspect of the invention, a rear end portion of the pentip and the forward end portions of the communication tubes are connected to each other so that the ink flows therebetween through the ink occlusion body.

In the direct-fluid-supply writing implement 1 as set forth in the fifth aspect of the invention, since a rear end of the pentip 2 and front end portions of the communication tubes 6 are not directly connected to each other, a predetermined quantity of ink is impregnated inside the ink occlusion body 3 between the rear end portion of the pentip 2 and the front end portions of the communication tubes 6. Therefore, even in the case where no ink is supplied from the ink tank 7, for example, in the case where the pentip is directed upward or in the case where the writing instrument is set in a horizontal state, writing can be sufficiently performed by the ink impregnated inside the ink occlusion body 3 between the rear end of the pentip 2 and the front end portions of the communication tubes 6.

According to a sixth aspect of the invention, as set forth in the first aspect of the invention, it is preferable that the forward end portions of the communication tubes are inserted from the rear of the ink occlusion body to the front so as to push and compress the inside of the ink occlusion body to the front, so that density of the ink occlusion body in a vicinity of the forward end portions of the communication tubes is set to be higher than density of the ink occlusion body in a portion except for the vicinity of the forward end portions of the communication tubes.

In the direct-fluid-supply writing implement 1 as set forth in the sixth aspect of the invention, the ink occlusion body 3 includes: a portion (high density portion 31) in which density in the vicinity of the front end portions of the communication tubes 6 is set high; and a portion (low density portion 32) in which density in portions except for the vicinity of the front end portions of the communication tubes 6 is set low. Therefore, ink in the ink occlusion body 3 can be preferentially impregnated in the high density portion 31 to the low density portion 32. Due to the foregoing, the front opening portions of the communication tubes 6 can be positively liquid-sealed by the impregnation ink. As a result, in the case where pressure in the ink tank 7 is reduced due to a decrease in temperature, ink impregnated in the ink occlusion body 3 does not remain in the ink occlusion body 3 but flows out from the high density portion 31 of the ink occlusion body 3 through the communication tubes 6 and appropriately returns to the ink tank 7.

In the direct liquid writing instrument 1 as set forth in the sixth aspect of the invention, a difference in density of the ink occlusion body 3, that is, a difference in the density of the high density portion 31 and the density of low density portion 32 of the ink occlusion body 3 is formed in such a manner that front end portions of the communication tubes 6 are inserted from the rear end portion of the ink occlusion body 3 to the front portion and the inside of the ink occlusion body 3 is pushed and compressed forward. Therefore, it is unnecessary to previously provide a difference in density in the ink occlusion body 3 before the communication tubes 6 are assembled into the ink occlusion body 3. Accordingly, manufacturing can be very easily performed.

According to a seventh aspect of the invention, as set forth in the first aspect of the invention, it is preferable that a front end opening portion of the ink tank before the opening portion is opened is closed with a plug body, a connection tube is protruded backward from a rear face of the partition wall, the connection tube is attached to the inside of the front end opening portion of the ink tank, the connection tube pushes the plug body so as to open the ink tank, the communication tube protruded backward from the rear face of the partition wall is located inside the connection tube, and the rear end of the communication tube protruded backward from the rear face of the partition wall is located at a position in a front portion of the rear end of the connection tube, or alternatively, a position in an axial direction of the rear end portion of the communication tube protruded backward from the rear face of the partition wall and a position in the axial direction of the rear end portion of the connection tube substantially coincide with each other.

In the direct-fluid-supply writing implement 1 as set forth in the seventh aspect of the invention, when the connection tube 54 is attached to the front opening portion of the ink tank 7, the connection tube 54 appropriately pushes the plug body 71 so that the plug body 71 can be positively pulled out from the ink tank 7. Further, there is no possibility that ink leaks outside from the ink tank 7 at the time of pulling out the plug body from the ink tank 7. If the rear end of the communication pipe **6*b* protruded backward from the rear face of the partition wall 52 is greatly protruded backward with respect to the rear end of the connection tube 54, when the connection tube 54 is inserted into the front end opening portion of the ink tank 7, the communication tube 6*b* comes into contact with the plug body 71. Therefore, it may become impossible to positively pull out the plug body from the ink tank 7. Further, there is a possibility that the plug body 71 is detached from the front end opening portion of the ink tank 7 before the connection tube 54 is completely attached to the front end opening portion of the ink tank 7**, and ink may leak outside.

According to an eighth aspect of the invention, as set forth in the seventh aspect of the invention, it is preferable that a protruding piece for pushing one side of the plug body at the time of opening the ink tank is arranged on one side at the rear of the connection tube, and an outer face of the communication tube protruded backward from the rear face of the partition wall and an inner face of the protruding piece are made to come close to each other.

In the direct-fluid-supply writing implement 1 as set forth in the eighth aspect of the invention, when the plug is pulled out from the ink tank 7, the protruding piece **54*a* pushes one side of the plug body 71. Therefore, the plug body 71 can be appropriately pulled out. In the case of a structure in which an outer face of the communication tube 6*b* protruded backward from a rear face of the partition wall 52 and an inner face of the protruding piece 54*a* do not come close to each other, the following problems may be encountered. When the plug is pulled out from the ink tank 7, the communication tube 6*b* protruded backward from the rear face of the partition wall 52 comes into contact with the plug body 71 and obstructs a smooth plug pullout motion of pulling out the plug body 71. Therefore, it becomes impossible to appropriately pull out the plug from the ink tank 7**.

According to a ninth aspect of the invention, as set forth in the first aspect of the invention, it is preferable that the ink occlusion body includes a high density portion and a low density portion connected at the rear of the high density portion, and the forward end portions of the communication tubes and the rear end of the pentip are located in the high density portion.

In the above direct-fluid-supply writing implement 1 as set forth in the ninth aspect of the invention, when ink 8 is supplied from the ink tank 7 into the ink occlusion body 3 under the condition that the pentip 2 is directed downward, ink 8 flows from the ink tank 7 by gravity and passes at least in one communication tube 6 and is supplied to the high density portion 31 of the ink occlusion body 3. Therefore, ink 8 is impregnated in the high density portion 31 described before. At the same time, the ambient air flows in the other communication tubes 6 and is taken into the ink tank 7.

When a predetermined quantity of ink is impregnated in the high density portion 31 of the ink occlusion body 3, the front end opening portions of the other communication tubes 6, which have been taking in the ambient air, are liquid-sealed by the impregnation ink and temporarily closed. Therefore, the supply of the ambient air into the ink tank 7 is stopped. At the same time, the supply of ink from the ink tank 7 to the ink occlusion body 3 through the communication tube 6, which has been supplying ink, is also stopped. As a result, the front end opening portions of the communication tubes 6 are put into a liquid-seal state and temporarily closed. Accordingly, an outflow of ink from the ink tank 7 and an inflow of air into the ink tank 7 are stopped, that is, a replacement of ink and air is stopped.

In the direct-fluid-supply writing implement 1 as set forth in the ninth aspect of the invention, the ink occlusion body 3 includes: a portion (high density portion 31) in which density in the vicinity of the front end portions of the communication tubes 6 is set high; and a portion (low density portion 32) in which density in portions except for the vicinity of the front end portions of the communication tubes 6 is set low. Therefore, ink in the ink occlusion body 3 can be preferentially impregnated in the high density portion 31 to the low density portion 32. Due to the foregoing, the front opening portions of the communication tubes 6 can be positively liquid-sealed by the impregnation ink. As a result, in the case where pressure in the ink tank 7 is reduced due to a decrease in temperature, ink impregnated in the ink occlusion body 3 does not remain in the ink occlusion body 3 but flows out from the high density portion 31 of the ink occlusion body 3 through the communication tubes 6 and appropriately returns to the ink tank 7.

In the direct-fluid-supply writing implement 1 as set forth in the ninth aspect of the invention, since the front end portions of the communications tubes 6 are located in the high density portion 31 of the ink occlusion body 3, all the front end portions of the communications tubes 6 can be easily closed with the liquid seal composed by ink impregnated in the ink occlusion body 3. As a result, no surplus ink is supplied from the ink tank 7 into the ink occlusion body 3. Accordingly, there is no possibility that ink leaks outside from the pentip 2 side.

In the direct-fluid-supply writing implement 1 as set forth in the ninth aspect of the invention, a rear end of the pentip 2 is located in the high density portion 31. Therefore, even when ink is not supplied from the ink tank 7, for example, even when the pentip is directed upward or the writing instrument body is horizontally set, writing can be sufficiently performed with ink impregnated in the high density portion 31 of the ink occlusion body 3.

According to a tenth aspect of the invention, as set forth in the ninth aspect of the invention, it is preferable that the communication tubes penetrate the inside of the low density portion, and the forward end portions of the communication tubes and the rear end portion of the pentip are located in the high density portion.

In the direct-fluid-supply writing implement 1 as set forth in the tenth aspect of the invention, the communication tubes 6 penetrate the inside of the low density portion 32. Therefore, the low density portion 32, the capacity of which is sufficiently large, can be provided without increasing an outer diameter of the portion in which the ink occlusion body 3 is accommodated. In the case where the communication tubes 6 are connected to the high density portion 31 without penetrating the inside of the low density portion 32, an outer diameter of the portion of the writing instrument body, in which the ink occlusion body 3 is accommodated, is increased and it becomes difficult for a user to hold the writing instrument body. Alternatively, a capacity of the low density portion 32 is reduced and there is a possibility that surplus ink can not be sufficiently absorbed from the ink tank 7.

According to an eleventh aspect of the invention, as set forth in the ninth aspect of the invention, when the forward end portions of the communication tubes are inserted into the ink occlusion body from the rear end, the front end portions of the communication tubes push and compress the inside of the ink occlusion body forward, so that the high density portion is formed inside the ink occlusion body in the vicinity of the forward end portion of the communication tubes.

In the direct liquid writing instrument 1 as set forth in the eleventh aspect of the invention, a difference in density of the ink occlusion body 3, that is, a difference in the density of the high density portion 31 and the density of low density portion 32 of the ink occlusion body 3 is formed in such a manner that front end portions of the communication tubes 6 are inserted from the rear end portion of the ink occlusion body 3 to the front portion and the inside of the ink occlusion body 3 is pushed and compressed forward. Therefore, it is unnecessary to previously provide a difference in density in the ink occlusion body 3 before the communication tubes 6 are assembled into the ink occlusion body 3. Accordingly, manufacturing can be very easily performed. Further, the front end portions of the communication tubes 6 and the high density portion 31 can be connected to each other without causing any defect.

According to a twelfth aspect of the invention, as set forth in the ninth aspect of the invention, it is preferable that the high density portion is formed when an outside of the ink occlusion body is pushed and compressed inward in a radial direction.

Due to the above constitution, it becomes unnecessary to previously provide a difference in density in the ink occlusion body 3. Therefore, the writing instrument 1 can be very easily manufactured.

According to a thirteenth aspect of the invention, as set forth in the ninth aspect of the invention, it is preferable that the high density portion is formed when a front end face of the ink occlusion body is pushed and compressed backward.

Due to the above constitution, it becomes unnecessary to previously provide a difference in density in the ink occlusion body 3. Therefore, the writing instrument 1 can be very easily manufactured.

According to a fourteenth aspect of the invention, as set forth in the ninth aspect of the invention, it is preferable that the ink occlusion body includes a first ink occlusion body, of which density is set at a high value, and a second ink occlusion body, of which density is set at a low value, wherein the first ink occlusion body forms the high density portion and the second ink occlusion body forms the low density portion.

Due to the above constitution, the high density portion 31 and the low density portion 32 can be positively set in the ink occlusion body 3 without causing any deviation, that is, a difference in density can be positively set in the ink occlusion body 3.

According to a fifteenth aspect of the invention, as set forth in the ninth aspect of the invention, it is preferable that a front end opening portion of the ink tank before the opening portion is opened is closed with a plug body, a connection tube is protruded backward from a rear face of the partition wall, the connection tube is attached to the inside of the front end opening portion of the ink tank, the connection tube pushes the plug body so as to open the ink tank, the communication tube protruded backward from the rear face of the partition wall is located inside the connection tube, and the rear end of the communication tube protruded backward from the rear face of the partition wall is located at a position in a front portion of the rear end of the connection tube, or alternatively, a position in an axial direction of the rear end portion of the communication tube protruded backward from the rear face of the partition wall and a position in the axial direction of the rear end portion of the connection tube substantially coincide with each other.

In the direct-fluid-supply writing implement 1 as set forth in the fifteenth aspect of the invention, when the connection tube 54 is attached to the front opening portion of the ink tank 7, the connection tube 54 appropriately pushes the plug body 71 so that the plug body 71 can be positively pulled out from the ink tank 7. Further, there is no possibility that ink leaks outside from the ink tank 7 at the time of pulling out the plug body from the ink tank 7. If the rear end of the communication pipe 6*b* protruded backward from the rear face of the partition wall 52 is greatly protruded backward with respect to the rear end of the connection tube 54, when the connection tube 54 is inserted into the front end opening portion of the ink tank 7, the communication tube 6*b* comes into contact with the plug body 71. Therefore, it may become impossible to positively pull out the plug body from the ink tank 7. Further, there is a possibility that the plug body 71 is detached from the front end opening portion of the ink tank 7 before the connection tube 54 is completely attached to the front end opening portion of the ink tank 7, and ink may leak outside.

According to a sixteenth aspect of the invention, as set forth in the fifteenth aspect of the invention, it is preferable that a protruding piece for pushing one side of the plug body at the time of opening the ink tank is arranged on one side at the rear of the connection tube, and an outer face of the communication tube protruded backward from the rear face of the partition wall and an inner face of the protruding piece are made to come close to each other.

In the direct-fluid-supply writing implement 1 as set forth in the sixteenth aspect of the invention, it is preferable that, when the plug is pulled out from the ink tank 7, the protruding piece 54*a* pushes one side of the plug body 71. Therefore, the plug body 71 can be appropriately detached. In the case of a structure in which an outer face of the communication tube 6*b* protruded backward from a rear face of the partition wall 52 and an inner face of the protruding piece 54*a* do not come close to each other, the following problems may be encountered. When the plug is pulled out from the ink tank 7, the communication tube 6*b* protruded backward from the rear face of the partition wall 52 comes into contact with the plug body 71 and obstructs a smooth plug pullout motion of pulling out the plug body 71. Therefore, it becomes impossible to appropriately pull out the plug from the ink tank 7.

According to a seventeenth aspect of the invention, there is provided a direct-fluid-supply writing implement comprising:

a pentip;

an ink occlusion body connected to a rear end of the pentip;

an ink tank that directly stores ink and is arranged at the rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, a connection tube attached to the front end opening portion of the ink tank is protruded backward with respect to the rear face of the partition wall, and flow passages is provided in the communication tubes so as to penetrate the partition wall located in the connection tube. (claim 17)

Each communication tube 6 of the direct-fluid-supply writing implement 1 as set forth in the seventeenth aspect of the invention, has a function of supplying ink 8 from the ink tank 7 into the ink occlusion body 3 and a function of supplying the ambient air into the ink tank 7. When the pentip 2 is directed downward at the time of supplying ink 8 from the ink tank 7 into the ink occlusion body 3, ink 8 flows by gravity from the ink tank 7 into the ink occlusion body 3 through at least one communication tube 6. Therefore, ink is impregnated in the ink occlusion body 3. At the same time, the ambient air is taken into the ink tank 7 through the other communication tubes 6. That is, in the case of communication tubes 6, the number of which is n (n is an integer of 2 or more), ink is supplied by the communication tubes 6, the number of which is not less than 1 and not more than (n−1), and the other residual communication tubes 6 supply the ambient air.

When a predetermined quantity of ink 8 is impregnated in the ink occlusion body 3, a forward end opening portion of the other communication tube 6, which has been taking in the ambient air, is sealed with the impregnated ink and temporarily closed. Therefore, the supply of the outside into the ink tank 7 is stopped. At the same time, ink supply from the ink tank 7 into the ink occlusion body 3 conducted by the communication tube 6, which has been supplying ink, is also stopped. As a result, the front end opening portions of the communication tubes 6 are put into a liquid-sealing state and temporarily closed. Accordingly, an outflow of ink from the ink tank 7 and an inflow of air into the ink tank 7 are stopped, (that is, a replacement of ink and air is stopped.

In the direct-fluid-supply writing implement 1, as set forth in the seventeenth aspect of the invention, front end portions of the communication tubes 6 are located in the ink occlusion body 3. Therefore, all the front end opening portions of the communication tubes 6 can be easily sealed by the liquid seal of ink which is impregnated in the ink occlusion body 3. As a result, no surplus ink is supplied from the ink tank 7 to the ink occlusion body 3. Accordingly, there is no possibility that ink leaks outside from the pentip 2 side.

The direct-fluid-supply writing implement 1 as set forth in the seventeenth aspect of the invention, includes a plurality of communication tubes 6, that is, two or more communication tubes 6. Therefore, when at least one communication tube 6 supplies ink, the other communication tubes 6 supply air. Therefore, at the initial state of supplying ink, that is, in the case where ink is first supplied to the ink occlusion body 3 which is not impregnated with ink, ink and air can be quickly replaced with each other. Accordingly, it becomes possible to start writing in a short period of time.

In the direct-fluid-supply writing implement 1 as set forth in the seventeenth aspect of the invention, the connection tube 54 capable of being attached to the front end opening portion of the ink tank 7 is protruded backward from the rear face of the partition wall 52, and the communication passages 62 in the communication tubes 6 penetrate the partition wall 52 located in the connection tube 54. Due to the above structure, only when the connection tube 54 is attached to the front end opening portion of the ink tank 7, ink and air can easily flows between the ink tank 7 and the ink occlusion body 3 through a plurality of communication tubes 6. Therefore when the ink tank 7 and the connection tube 54 are connected to each other, ink and air can be quickly replaced with each other. Accordingly, writing can be started in a short period of time.

In the direct-fluid-supply writing implement 1 as set forth in the seventeenth aspect of the invention, the ink tank 7 can be replaced, the front end opening portion of the ink tank 7 is closed with the plug body 71, the connection tube 54 is attached to the front end opening portion of the ink tank 7 and the plug is pulled out from the ink tank 7 by pushing and compressing the plug body 71.

According to an eighteenth aspect of the invention, as set forth in the seventeenth aspect of the invention, it is preferable that the flow passages of the communication tubes penetrate portions except for an axial center of the partition wall located in the connection tube.

In the direct-fluid-supply writing implement 1 as set forth in the eighteenth aspect of the invention, the communication passages 62 can be easily arranged on the partition wall 52 without causing any deviation. As a result, when the writing instrument body is put into a horizontal state, there is a high possibility that ink 8 is supplied from the ink tank 7 into any communication passage 62. Ink 8 can be supplied from the ink tank 7 into the ink occlusion body 3 through any circulation passage 62. Therefore, it is possible to evade a case in which writing can not be performed.

According to a nineteenth aspect of the invention, as set forth in the seventeenth aspect of the invention, it is preferable that the partition wall, the communication tubes and the connection tube are integrated into one body.

In the above direct-fluid-supply writing implement 1 as set forth in the nineteenth aspect of the invention, the partition wall 52, the communication tubes 6 and the connection tube 54 can be formed out of one part. Therefore, the number of parts can be reduced and the structure can be simplified. Accordingly, it is possible to provide a writing instrument to a user at a low price. It is preferable that the partition wall 52, the communication tubes 6 and the connection tube 54 are formed out of a forming body made of synthetic resin being integrated into one body.

According to a twentieth aspect of the invention, as set forth in the seventeenth aspect of the invention, it is preferable that an attaching cylindrical portion that surrounds a base portion of each communication tube or a base portion of the connection tube is integrally formed on the partition wall, and an outer face of the attaching cylindrical portion is fixed onto an inner face of the barrel.

In the above direct-fluid-supply writing implement 1 as set forth in the twentieth aspect of the invention, the partition wall 52, the communication tubes 6, and the connection tube 54 and the attaching cylindrical portion 55 can be respectively formed out of one part. Therefore, the number of parts can be further reduced. Accordingly, it is possible to suppress an increase in the manufacturing cost. Further, the partition wall 52 can be stably attached onto an inner face of the barrel 11 by the attaching cylindrical portion 55 without causing any unsteadiness. In the direct-fluid-supply writing implement 1, as set forth in the twentieth aspect of the invention, the attaching cylindrical portion 55 may be composed in such a manner that it surrounds at least one of the base portion of each communication tube 6 and the base portion of the connection tube 54. However, the attaching cylindrical portion 55 may be composed in such a manner that it surrounds both the base portion of each communication tube 6 and the base portion of the connection tube 54. In this connection, the barrel 11 is a member for holding the pentip 2 and the ink occlusion body 3.

According to a twenty-first aspect of the invention, as set forth in the seventeenth aspect of the invention, it is preferable that the ink occlusion body includes a high density portion and a low density portion connected to a rear portion of the high density portion, and front end portions of the communication tubes and a rear end portion of the pentip are located in the high density portion.

In the direct-fluid-supply writing implement 1 as set forth in the twenty-first aspect of the invention, the ink occlusion body 3 includes: a portion (high density portion 31) in which density in the vicinity of the front end portions of the communication tubes 6 is set high; and a portion (low density portion 32) in which density in portions except for the vicinity of the front end portions of the communication tubes 6 is set low. Therefore, ink in the ink occlusion body 3 can be preferentially impregnated in the high density portion 31 to the low density portion 32. Due to the foregoing, the front opening portions of the communication tubes 6 can be positively liquid-sealed by the impregnation ink. As a result, in the case where pressure in the ink tank 7 is reduced due to a decrease in temperature, ink impregnated in the ink occlusion body 3 does not remain in the ink occlusion body 3 but flows out from the high density portion 31 of the ink occlusion body 3 through the communication tubes 6 and appropriately returns to the ink tank 7.

In the direct-fluid-supply writing implement 1, as set forth in the twenty-first aspect of the invention, front end portions of the communication tubes 6 are composed in such a manner that they are connected to the high density portion 31 of the ink occlusion body 3. Therefore, all the front end opening portions of the communication tubes 6 can be easily sealed by the liquid seal of ink which is impregnated in the ink occlusion body 3. As a result, no surplus ink is supplied from the ink tank 7 to the ink occlusion body 3. Accordingly, there is no possibility that ink leaks outside from the pentip 2 side.

In the direct-fluid-supply writing implement 1, as set forth in the twenty-first aspect of the invention, due to the structure in which the rear end portion of the pentip 2 is connected to the high density portion 31, even in the case where no ink is supplied from the ink tank 7, for example, even in the case where the pentip is directed upward, writing can be sufficiently performed by ink impregnated in the high density portion 31 of the ink occlusion body 3.

According to a twenty-second aspect of the invention, there is provided a direct-fluid-supply writing implement comprising:

a pentip;

an ink occlusion body connected to a rear end of the pentip;

an ink tank that directly stores ink, and is arranged at the rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, a contact wall portion that comes into contact with a portion of the rear end face of the ink occlusion body is provided on a front face of the partition wall, when the contact wall portion and the rear end face of the ink occlusion body are contacted with each other, a gap that communicates with an ambient air is formed between the rear end face of the ink occlusion body and the front face of the partition wall, the contact wall portion is connected to a base portion of each communication tube and the front face of the partition wall, and the contact wall portion connects the base portions of the communication tubes to each other.

Each communication tube 6 of the direct-fluid-supply writing implement 1, as set forth in the twenty-second aspect of the invention, has a function of supplying ink 8 from the ink tank 7 into the ink occlusion body 3 and a function of supplying the ambient air into the ink tank 7. When the pentip 2 is directed downward at the time of supplying ink 8 from the ink tank 7 into the ink occlusion body 3, ink 8 flows by gravity from the ink tank 7 into the ink occlusion body 3 through at least one communication tube 6. Therefore, ink is impregnated in the ink occlusion body 3. At the same time, the ambient air is taken into the ink tank 7 through the other communication tubes 6. That is, in the case of communication tubes 6, the number of which is n (n is an integer of 2 or more), ink is supplied by the communication tubes 6, the number of which is not less than 1 and not more than (n−1), and the other residual communication tubes 6 supply the ambient air.

When a predetermined quantity of ink 8 is impregnated in the ink occlusion body 3, a forward end opening portion of the other communication tube 6, which has been taking in the ambient air, is sealed with the impregnated ink and temporarily closed. Therefore, the supply of the outside into the ink tank 7 is stopped. At the same time, ink supply from the ink tank 7 into the ink occlusion body 3 conducted by the communication tube 6, which has been supplying ink, is also stopped. As a result, the front end opening portions of the communication tubes 6 are put into a liquid-sealing state and temporarily closed. Accordingly, an outflow of ink from the ink tank 7 and an inflow of air into the ink tank 7 are stopped, that is, a replacement of ink and air is stopped.

In the direct-fluid-supply writing implement 1 described above, as set forth in the twenty-second aspect of the invention, front end portions of the communication tubes 6 are located in the ink occlusion body 3. Therefore, all the front end opening portions of the communication tubes 6 can be easily sealed by the liquid seal of ink which is impregnated in the ink occlusion body 3. As a result, no surplus ink is supplied from the ink tank 7 to the ink occlusion body 3. Accordingly, there is no possibility that ink leaks outside from the pentip 2 side.

The direct-fluid-supply writing implement 1, as set forth in the twenty-second aspect of the invention, includes a plurality of communication tubes 6, that is, two or more communication tubes 6. Therefore, when at least one communication tube 6 supplies ink, the other communication tubes 6 supply air. Therefore, at the initial state of supplying ink, that is, in the case where ink is first supplied to the ink occlusion body 3 which is not impregnated with ink, ink and air can be quickly replaced with each other. Accordingly, it becomes possible to start writing in a short period of time.

In the direct-fluid-supply writing implement 1, as set forth in the twenty-second aspect of the invention, the gap 9, which can be communicated with the ambient air, is formed between the rear end face of the ink occlusion body 3 and the front face of the partition wall 52. Therefore, air inside the ink occlusion body 3 can be made to flow outside from the rear end face of the ink occlusion body 3. Due to the foregoing, when pressure in the ink tank 7 is raised because of a rise in temperature, ink, which has been pushed out from the ink tank 7, is smoothly moved backward from the front end portion of each communication tube 6 through the ink occlusion body 3 in the vicinity of the front end of each communication tube 6. Therefore, this ink is impregnated at the rear portion of the ink occlusion body 3 and prevented from leaking outside. On the other hand, when pressure in the ink tank 7 is reduced due to a decrease in temperature, ink, which is impregnated in the rear portion of the ink occlusion body 3, can be returned into the ink tank 7 through the front end portion of the communication tube 6 in the ink occlusion body 3 from the front end opening portion of the communication tube 6 via the communication tube 6. Especially, in the direct-fluid-supply writing implement 1 as set forth in the twenty-second aspect of the invention, a backward movement of the ink occlusion body 3 can be regulated by the contact wall portion 52*b* and further the gap 9 can be positively formed between the rear end face of the ink occlusion body 3 and the front face of the partition wall 52.

In the direct-fluid-supply writing implement 1, as set forth in the twenty-second aspect of the invention, the contact wall portion 52*b* is connected to the base end portion of each communication tube 6 and the front face of the partition wall 52. Therefore, the bending strength of the communication tube 6 with respect to the partition wall 52 is enhanced. Accordingly, it is possible to prevent the communication tube 6 from being bent. In the direct-fluid-supply writing implement 1, as set forth in the twenty-second aspect of the invention, since the contact wall portion 52*b* is formed in the base portion of each communication tube 6, the contact wall portion 52*b* can be provided in a wide range. Therefore, the rear end face of the ink occlusion body 3 and the contact wall portion 52*b* can be stably contacted with each other.

In the direct-fluid-supply writing implement 1, as set forth in the twenty-second aspect of the invention, since the contact wall portion 52*b* and the base portion of each communication tube 6 are connected to each other, the bending strength of the communication tube 6 with respect to the partition wall 52 can be further enhanced and the communication tubes 6 can be prevented from being bent.

According to a twenty-third aspect of the invention, as set forth in the twenty-second aspect of the invention, it is preferable that the contact wall portion is made of a plate-shaped rib protruding in an axial direction.

In the direct-fluid-supply writing implement 1, as set forth in the twenty-third aspect of the invention, it is possible to obtain a sufficiently high ventilation property on the rear end face of the ink occlusion body 3. Further, it is possible to obtain a stable contact with the rear end face of the ink occlusion body 3. Further, it is preferable that a lateral cross-section of the plate-shaped rib described before is formed into a radial shape from the viewpoint of connecting the base portions of the communication tubes 6 with each other and obtaining a stable contact with the rear end face of the ink occlusion body 3.

According to a twenty-fourth aspect of the invention, as set forth in the twenty-second aspect of the invention, it is preferable that the ink occlusion body includes a high density portion and a low density portion connected to a rear portion of the high density portion, and front end portions of the communication tubes and a rear end portion of the pentip are located in the high density portion.

In the direct-fluid-supply writing implement 1, as set forth in the twenty-fourth aspect of the invention, the ink occlusion body 3 includes: a portion (high density portion 31) in which density in the vicinity of the front end portions of the communication tubes 6 is set high; and a portion (low density portion 32) in which density in portions except for the vicinity of the front end portions of the communication tubes 6 is set low. Therefore, ink in the ink occlusion body 3 can be preferentially impregnated in the high density portion 31 to the low density portion 32. Due to the foregoing, the front opening portions of the communication tubes 6 can be positively liquid-sealed by the impregnation ink. As a result, in the case where pressure in the ink tank 7 is reduced due to a decrease in temperature, ink impregnated in the ink occlusion body 3 does not remain in the ink occlusion body 3 but flows out from the high density portion 31 of the ink occlusion body 3 through the communication tubes 6 and appropriately returns to the ink tank 7.

In the direct-fluid-supply writing implement 1, as set forth in the twenty-fourth aspect of the invention, the front end portion of each communication tube 6 is connected to the high density portion 31 of the ink occlusion body 3. Therefore, all the front end opening portions of the communication tubes 6 can be easily closed with a liquid seal of the ink impregnated in the ink occlusion body 3. As a result, there is no possibility that surplus ink is supplied from the ink tank 7 into the ink occlusion body 3. Accordingly, no ink leaks outside from the pentip 2 side.

In the direct-fluid-supply writing implement 1, as set forth in the twenty-fourth aspect of the invention, due to the structure in which the rear end portion of the pentip 2 is connected to the high density portion 31, even in the case where no ink is supplied from the ink tank 7, for example, even in the case where the pentip is directed upward, writing can be sufficiently performed by ink impregnated in the high density portion 31 of the ink occlusion body 3.

According to a twenty-fifth aspect of the invention, as set forth in the twenty-second aspect of the invention, it is preferable that a connection tube attached to the front end opening portion of the ink tank is protruded backward from the rear face of the partition wall, and the partition wall, the communication tubes, the contact wall portion and the connection tube are integrated with each other.

In the direct-fluid-supply writing implement 1, as set forth in the twenty-fifth aspect of the invention, the partition wall 52, the communication tubes 6, the contact wall portion 52*b* and the connection tube 54 can be formed into one component.

According to a twenty-sixth aspect of the invention, as set forth in the twenty-second aspect of the invention, it is preferable that an attaching cylindrical portion surrounding a base portion of each communication tube or a base portion of the connection tube is provided so as to be integrated with the partition wall, and an outer face of the attaching cylindrical portion is fixed onto an inner face of the barrel.

In the above direct-fluid-supply writing implement 1, as set forth in the twenty-sixth aspect of the invention, the partition wall 52 can be stably attached onto an inner face of the cylinder 11 by the attaching cylindrical portion 55 without causing any unsteadiness. In the direct-fluid-supply writing implement 1 as set forth in the twenty-sixth aspect of the invention, the attaching cylindrical portion 55 may be composed in such a manner that it surrounds at least one of the base portion of each communication tube 6 and the base portion of the connection tube 54. However, the attaching cylindrical portion 55 may be composed in such a manner that it surrounds both the base portion of each communication tube 6 and the base portion of the connection tube 54. In this connection, the barrel 11 is a member for holding the pentip 2 and the ink occlusion body 3.

According to a twenty-seventh aspect of the invention, as set forth in one of the first through the twenty-sixth aspect of the invention, it is preferable that a void ratio of the ink occlusion body 3 in a portion except for the vicinity of the front end portion of each communication tube 6 is 70% to 95%, and a difference between the void ratio of the ink occlusion body 3 in a portion except for the vicinity of the front end portion of each communication tube 6 and the void ratio of the ink occlusion body 3 in a portion in the vicinity of the front end portion of each communication tube 6 is not less than 7%, and preferably not less than 10%.

In the direct-fluid-supply writing implement 1 according to the twenty-seventh aspect of the invention, the void ratio of the ink occlusion body 3 in a portion except for the vicinity of the front end portion of each communication tube 6 is a void ratio of the ink occlusion body 3 in a portion (low density portion 32), the density of which is low, except for a portion in the vicinity of the forward end portions each communication tube 6. The void ratio of the ink occlusion body 3 in a portion in the vicinity of the front end portion of each communication tube 6 is a void ratio of the ink occlusion body 3 in a portion (high density portion 31), the density of which is high, in the vicinity of the front end portion of each communication tube 6. When the void ratio of the low density portion 32 is set in the range from 70% to 95% and the difference between the void ratio of the low density portion 32 and the void ratio of the high density portion 31 is set at a value 7% or more, the front end opening portion of each communication tube 6 can be positively liquid-sealed by the impregnated ink.

According to a twenty-eighth aspect of the invention, as set forth in one of the first through twenty-seventh aspect of the invention, it is preferable that a distance S1, S2 in the axial direction from the front end portion of the ink occlusion body 3 to the front end portion of each communication tube 6 is set at a value not less than 3% and not more than 50% of the length in the axial direction of the entire ink occlusion body 3, and preferably, a value not less than 3% and not more than 30%.

In the direct-fluid-supply writing implement 1, as set forth in the twenty-eighth aspect of the invention, at the time of a rise in the inner pressure of the ink tank 7, no ink leaks outside from the front end portion of the ink occlusion body 3. Further, no handwriting is broken and blurred, that is, a sufficient quantity of ink flows out from the pentip 2. When the distance S1, S2 in the axial direction from the front end portion of the ink occlusion body 3 to the front end portion of each communication tube 6 located at the rear of the ink occlusion body 3 is set at a value lower than 3%, there is a possibility that ink leaks out from the front end portion of the ink occlusion body 3 at the time of a rise in the inner pressure of the ink tank 7. When the distance S1, S2 in the axial direction from the front end portion of the ink occlusion body 3 to the front end portion of each communication tube 6 located at the rear of the ink occlusion body 3 exceeds 50% of the length in the axial direction of the entire ink occlusion body 3, a distance from the front end portion of each communication tube 6 to the pentip 2 is extended, which may deteriorate the flowing property of ink.

According to a twenty-ninth aspect of the invention, as set forth in one of the first through twenty-eighth aspect of the invention, it is preferable that distances S1 and S2 from the front end portion of the ink occlusion body 3 to the front end portions of the communication tubes 6 are set equally to each other.

In the direct-fluid-supply writing implement 1, as set forth in the twenty-ninth aspect of the invention, a distance between the respective front end portions of the communication tubes 6 inside the ink occlusion body 3 is further reduced. Accordingly, the liquid-sealing property of the front end opening portion of each communication tube 6 is enhanced and a leakage of ink can be more positively prevented.

According to a thirtieth aspect of the invention, as set forth in the first through twenty-ninth aspect of the invention, it is preferable that a distance T1, T2 in the axial direction from the front end portion of each communication tube 6 to the rear end of the pentip 2 is set at a value not more than 10 mm.

In the direct-fluid-supply writing implement 1, as set forth in the thirtieth aspect of the invention, at the time of initial supply of ink, ink is quickly supplied form the front end portion of each communication tube 6 to the rear end portion of the pentip 2. Therefore, writing can be started in a short period of time. If a distance T1, T2 in the axial direction from the front end portion of each communication tube 6 to the rear end portion of the pentip 2 exceeds 10 mm, the distance from the front end portion of each communication tube 6 to the rear end portion of the pentip 2 is increased. Therefore, it becomes impossible to quickly supply ink from the front end portion of each communication tube 6 to the rear end portion of the pentip 2. Accordingly, a fairly long period of time is required to start writing at the initial supply of ink. In this connection, the front end portion of each communication tube 6 may be located at a position in the front of the rear end portion of the pentip 2. Alternatively, the front end portion of each communication tube 6 may be located at a position at the rear of the rear end portion of the pentip 2.

According to a thirty-first aspect of the invention, as set forth in the first through thirtieth aspect of the invention, it is preferable that intervals between the front end portions of the communication tubes 6 and the rear end portion of the pentip 2 are equally set.

In the direct-fluid-supply writing implement 1, as set forth in the thirty-first aspect of the invention, at the time of initial supply of ink, even when ink is supplied from the ink tank 7 to the rear end portion of the pentip 2 through the front end opening portion of any communication tube 6 in a plurality of communication tubes 6, writing can be surely started in a predetermined period of time.

According to a thirty-second aspect of the invention, as set forth in the first through thirty-first aspect of the invention, it is preferable that a front end face and a rear end face of the ink occlusion body 3 are communicated with the ambient air.

In the direct-fluid-supply writing implement 1, as set forth in the thirty-second aspect of the invention, air inside the ink occlusion body 3 can be made to flow from the front end face and the rear end face of the ink occlusion body 3. Due to the foregoing, ink, which has been supplied from the front end opening portion of the communication tube 6 inside the ink occlusion body 3, can be smoothly moved from the vicinity of the front end of the communication tube 6 inside the ink occlusion body 6 to the front end of the ink occlusion body 3, and ink, which has been supplied from the front end opening portion of the communication tube 6 inside the ink occlusion body 3, can be smoothly moved from the inside of the ink occlusion body 3 in the vicinity of the front end of the communication tube 6 to the rear end of the ink occlusion body 3. Especially when the rear end face of the ink occlusion body 3 is communicated with the ambient air, at the time of a rise in pressure in the ink tank 7 caused by an increase in temperature, ink pushed out from the ink tank 7 is smoothly moved backward from the front end portion of the communication tube 6 through the vicinity of the front end of the communication tube 6 of the ink occlusion body 3 and impregnated so that a leakage of ink to the outside can be prevented. On the other hand, at the time of a reduction of pressure in the ink tank 7 caused by a decrease in temperature, ink impregnated at the rear of the ink occlusion body 3 can be returned into the ink tank 7 from the front end opening portion of the communication tube 6 through the communication tube 6 via the vicinity of the front end of the communication tube 6 inside the ink occlusion body 3.

According to a thirty-third aspect of the invention, as set forth in the first through thirty-second aspect of the invention, it is preferable that an ink absorbing body 63 having capillary gaps is arranged inside each communication tube 6.

Due to the direct-fluid-supply writing implement 1, as set forth in the thirty-third aspect of the invention, even when an outer diameter and an inner diameter of each communication tube 6 are set at relatively high values in order to prevent the communication tube 6 from being bent, the front end portion of the communication tube 6 can be appropriately liquid-sealed.

According to a thirty-fourth aspect of the invention, as set forth in the first through thirty-third aspect of the invention, it is preferable that respective side walls of the communication tubes 6 are respectively connected to each other.

Due to the direct-fluid-supply writing implement 1, as set forth in the thirty-fourth aspect of the invention, the bending strength of each communication tube 6 is enhanced. Therefore, it is possible to prevent each communication tube 6 from being bent.

According to a thirty-fifth aspect of the invention, as set forth in the ninth aspect of the invention, it is preferable that the rear end of the pentip 2 and the front end of each communication tube 6 are connected to each other so that ink flows through the high density portion 31.

In the direct-fluid-supply writing implement 1, as set forth in the thirty-fifth aspect of the invention, since the rear end portion of the pentip 2 and the front end portion of each communication tube 6 are not directly connected to each other, a predetermined quantity of ink is impregnated in the ink occlusion body 3 provided between the rear end portion of the pentip 2 and the front end portion of each communication tube 6. Accordingly, even when no ink is supplied from the ink tank 7, for example, even when the pentip is directed upward or the writing instrument body is put in a horizontal state, writing can be sufficiently performed by the ink impregnated in the ink occlusion body 3 provided between the rear end portion of the pentip 2 and the front end portion of each communication tube 6. Further, there is no possibility that surplus ink is directly supplied from the ink tank 7 to the pentip 2 and leaks outside.

According to a thirty-sixth aspect of the invention, as set forth in one of the first through thirty-fifth aspects of the invention, it is preferable that a volume V2 of the ink occlusion body 3 is set larger than 40% of a volume V1 of a space defined among the ink tank 7 and respective communication tube 6 (preferably, larger than 50% of the volume V1).

Due to the ratio of volume V2 against the volume V2 being set as 40% or larger (preferably 50% or larger), when the pressure in the ink tank 7 drastically changes, although the ink 8 in the ink tank 7 is strongly pushed out throughout the communication tube 6, the ink 8 is properly impregnated into the ink occlusion body 3. Therefore, it is sufficiently prevented the ink 8 from leaking or blowing-off from the pen tip 2 side to outside.

when the ratio of volume V2 is less than 40% of the volume V1, when the pressure in the ink tank 7 drastically change, there is a fear that ink flowed from the ink tank 7 cannot be held sufficiently in the ink occlusion body 3.

Further, the volume V2 is preferably set to be less than 70% of the volume V1. When the volume V2 exceeds 70% of the volume V1, ink amount accommodated in the ink tank 7 is extremely small and writing-feasible length of the direct-fluid-supply implement 1 becomes small, and such a case is impractical. Therefore, the ratio of volume V2 against the volume V1 is preferably 40~70%, and more preferably, 50~70%.

Note that the volume V1 of a space defined between the ink tank 7 and the respective communication tube 6 is, sum of a volume in the ink tank 7 and the sum of the volumes of the respective communication tube 6. The volume V2 of the ink occlusion body 3 is, a volume of the ink occlusion body 3 excluding the pent tip 2 and respective parts of the communication tube 6 which is inserted into the ink occlusion body 3.

Communication Tube

In the present invention, from the viewpoint of having a predetermined rigidity, it is preferable that the communication tube 6 is made of synthetic resin or metal. Laterally cross-sectional shapes of the outer circumferential face and the inner circumferential face of the communication tube 6 may be any of a circle, an ellipse and a polygon such as a triangle or a square. The number of the communication tubes 6 may be plural, that is, the number of the communication tubes 6 may be not less than two. For example, the number of the communication tubes 6 may be 2, 3, 4, 5, 6 and more.

Each communication tube 6 is extended in the longitudinal direction. Inside each communication tube 6, a flow passage 62 is provided in the longitudinal direction. That is, each communication tube 6 has opening portions at both end portions which are formed at the front and the rear end.

The plurality of communication tubes 6 may be composed in such a manner that a plurality of independent flow passages 62 are formed inside the communication tubes 6 in parallel with each other. For example, the following structure may be adopted. The communication tubes 6 are separate from each other in the radial direction as shown in FIGS. 1 to 5. Sides of the communication tubes 6 are connected to each other as shown in FIGS. 6 to 8, FIGS. 13 to 18 and FIGS. 22 to 25. Alternatively, small communication tubes 6*b* are arranged inside large diameter communication tubes 6*a* as shown in FIG. 9.

It is preferable that front end portions of the communication tubes 6 are located on the same circumference centered at the pentip 2 at regular intervals. The front end portion of each communication tube 6 may be open to the front in the axial direction. Alternatively, the front end portion of each communication tube 6 may be open to the outside in the radial direction. A shape of the front end portion of each communication tube 6 is, for example, an inclined cut face, a perpendicular face, a conical face or a convex face. A rear end of each communication tube 6 may be open backward in the axial direction or outward in the radial direction.

A rear end portion of each communication tube 6 may be protruded backward from the rear face of the partition wall 52. However, it is preferable that at least one communication tube 6*b* is greatly protruded backward from the rear face of the partition wall 52 and the rear end portions of the other communication tubes 6*a* are located at positions in the front of the rear end portion of the communication tube 6*b* protruded backward. Alternatively, it is preferable that the rear end portions of the other communication tubes 6*a* are not protruded from the rear face of the partition wall 52, that is, it is preferable that the rear end portions of the communication tubes 6*a* and the rear face of the partition wall 52 are made to coincide with each other.

Ink Occlusion Body

In the present invention, the ink occlusion body 3 may be made of material having continuous blow holes in which ink can be impregnated, that is, the ink occlusion body 3 may be made of porous material. For example, the ink occlusion body 3 may be a fiber bundle heat fusion body, a fiber bundle resin body, a felt resin body, a felt needle punch body or a synthetic resin continuous blow hole body. The ink occlusion body 3 may be composed in such a manner that the outer circumferential face is covered with skin formed out of a synthetic resin film. An inside front portion of the ink occlusion body 3 is defined as an inside of the front half portion of the ink occlusion body 3. The ink occlusion body 3 may be a single member. Alternatively, the ink occlusion body 3 may be a plurality of members, the capillary forces of which are different from each other.

Density of the Ink Occlusion Body

In the present invention, density of the ink occlusion body 3 is density of a porous organization such as density of fiber density. In the high density portion 31 of the ink occlusion body 3, the gap width of the capillary interval is reduced. In the low density portion 32 of the ink occlusion body 3, the gap width of the capillary interval is extended. Therefore, a capillary force of the high density portion 31 is stronger than a capillary force of the low density portion 32.

Pentip

In the present invention, examples of the pentip 2 are: a fiber bundle resin body, a fiber bundle heat fusion body, a felt body, a pipe-shaped pen body, a fountain pen type plate-like pen body having a slit at the tip, a brush pen body, a synthetic resin porous blow hole body, a ball point pen chip, and a synthetic resin extruded body having an ink inducing passage. Material, which composes the rear end portion of the pentip 2, may be at least a material having capillary gaps by which the rear end portion of the pentip 2 can be appropriately connected with the ink occlusion body 3. Examples of the material, which composes the rear end portion of the pentip 2, are: porous material such as a fiber bundle resin body, a fiber bundle heat fusion body, a felt body, a synthetic resin porous blow hole body; and a synthetic resin extruded body having an ink inducing passage in the axial direction. In this connection, in the present invention, the pentip 2 includes an ink inducing member.

Ink Occlusion Body

In this connection, the ink occlusion body 63 may be provided with capillary gaps. Examples of the ink occlusion body 63 are: porous material such as a fiber bundle resin body, a fiber bundle heat fusion body, a felt body, a synthetic resin porous blow hole body; and a synthetic resin extruded body having an ink inducing passage in the axial direction. It is preferable that a capillary force of the ink occlusion body 63 is set to be lower than the capillary force of the front end vicinity portion (high density portion 31) of each communication tube 6 inside the ink occlusion body 3.

Partition Wall

The partition wall 52 divides the ink occlusion body 3 and the ink tank 7. Actually, the partition wall 52 divides the ink tank 7 and the occlusion body accommodating portion for accommodating the ink occlusion body 3. The rear face of the partition wall 52 faces the ink tank 7.

Ink Tank

Examples of the structure of the ink tank 7 are: a structure in which the ink tank 7 is directly formed in the writing instrument body, that is, as shown in FIG. 1, the ink tank 7 composes a portion of the writing instrument body; and a structure in which the ink tank 7 is accommodated in the writing instrument body as shown in FIGS. 13 and 16. In the present invention, ink 8 is specifically ink used for writing utensils, for example, water-color ink or oil-based ink. Alternatively, ink 8 is specifically a coating solution such as a face lotion, a cover-up liquid, an adhesive agent a paint or a liquid medical supply.

ADVANTAGE OF THE INVENTION

According to the present invention, there is no possibility that ink leaks out from the ink tank onto a pentip side. Further, at the time of initial supply of ink, ink and air can be quickly replaced with each other. Therefore, writing can be started in a short period of time. Furthermore, the structure can be made simple. Even when a sudden change in pressure is generated while the pentip is being directed downward, it is possible to prevent ink from leaking out and blowing up from the pentip.

DETAILED DESCRIPTION OF EXEMPLARY EMBODIMENTS OF THE INVENTION EMBODIMENTS

First Embodiment

Figure 1:
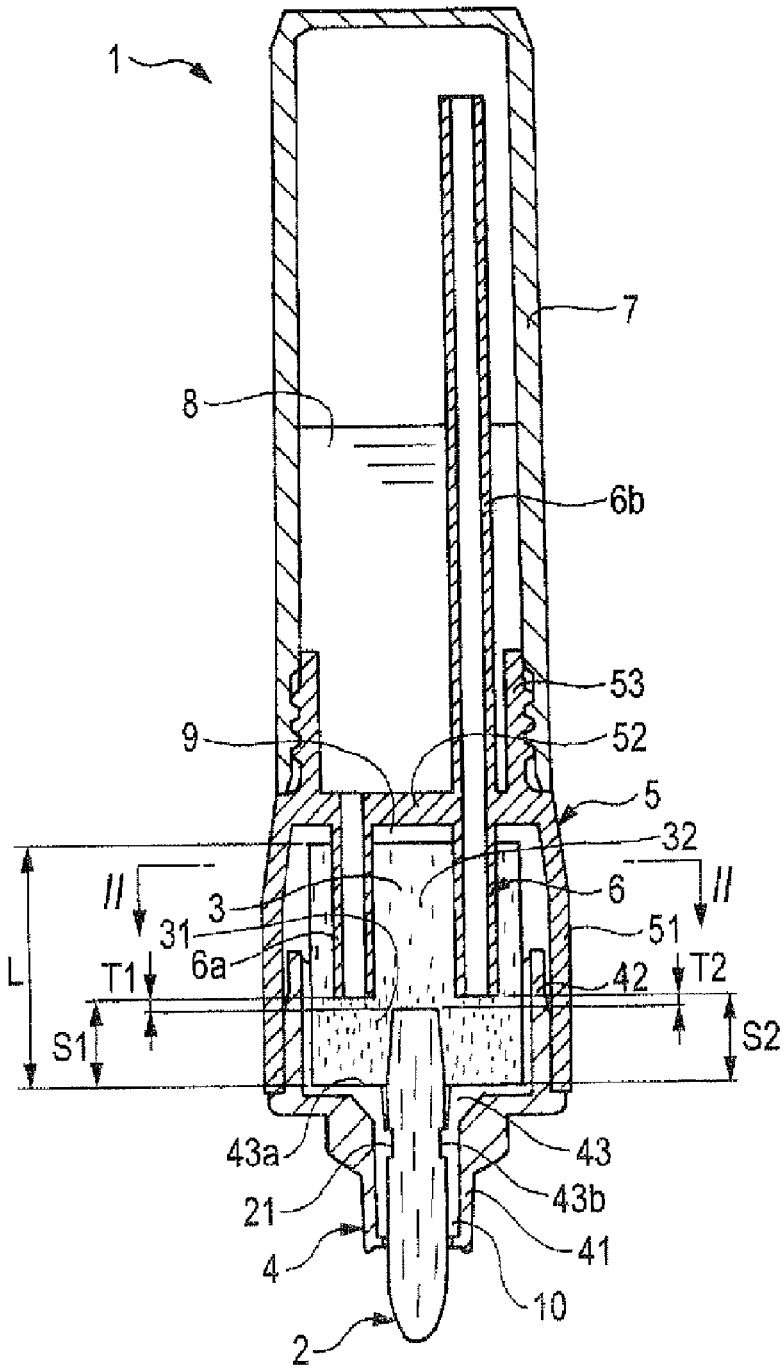
FIG. 1 is a longitudinal sectional view showing a state in which a pentip is directed downward of the first embodiment of the present invention.
Figure 2:
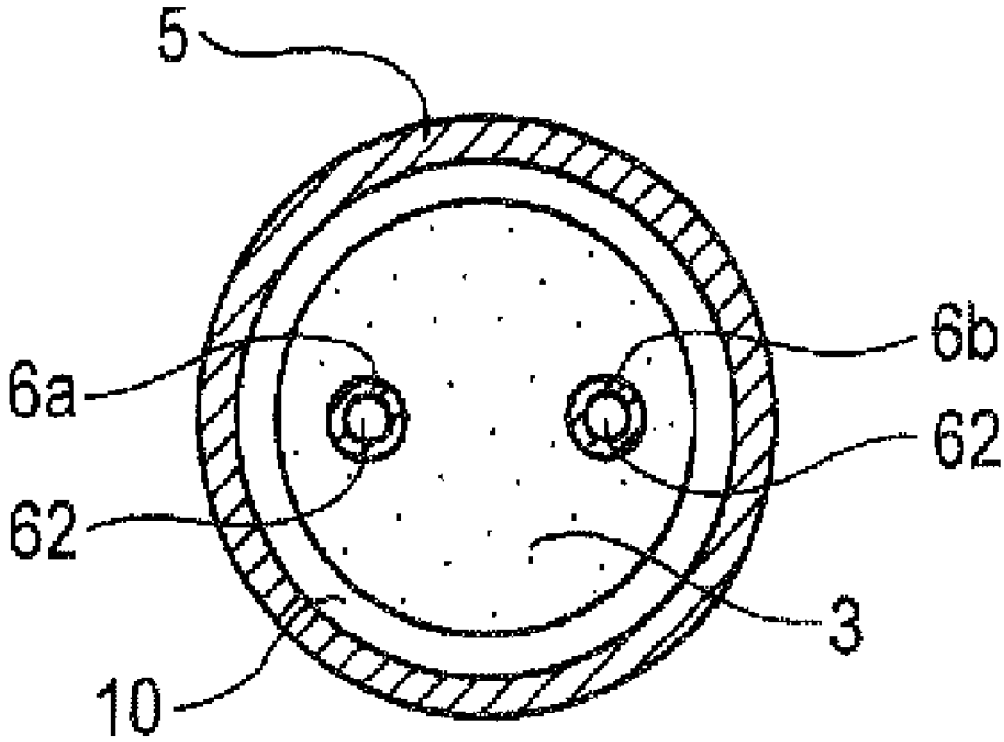
FIG. 2 is a sectional view taken on line II-II in FIG. 1.

A direct-fluid-supply writing implement 1 of the first embodiment of the present invention is shown in FIGS. 1 and 2.

The direct-fluid-supply writing implement 1 of the present embodiment includes: a pentip 2; an ink occlusion body 3 connected to a rear end portion of the pentip 2; an occlusion accommodating portion for holding the pentip 2 at a front end portion and for accommodating the ink occlusion body 3 inside; an ink tank 7 which is attached at the rear of the occlusion accommodating portion and directly stores ink 8 inside; a partition wall 52 for dividing the occlusion accommodating portion and the ink tank 7; and a plurality of communication tubes 6, specifically two communication tubes 6 which are protruded forward from the front face of the partition wall 52 and connected to the ink occlusion body 3 when the communication tubes 6 penetrate the inside of the ink occlusion body 3. The occlusion body accommodating portion includes: a front member 4 for holding the pentip 2; and an intermediate member 5 for connecting the front member 4 with the ink tank 7.

Pentip

The pentip 2 is a rod-shaped body made of synthetic resin fiber such as polyester fiber, acrylic fiber or nylon fiber. A forward end portion of the pentip 2 is ground into a bullet-shape. An outer circumferential face of the rear end portion of the pentip 2 is chamfered being tapered. In an intermediate portion of the pentip 2, an annular groove 21 is formed.

Ink Occlusion Body

The ink occlusion body 3 is formed out of a columnar worked body made of synthetic resin fiber, for example, polyester fiber. An outer circumferential face of the ink occlusion body 3 is covered with cylindrical skin. The skin is formed out of a synthetic resin film, for example, a polyethylene terephthalate film. A rear end portion of the pentip 2 is inserted into an axial center of the front end face of the ink occlusion body 3 in such a manner that the rear end portion of the pentip 2 pierces the front end face of the ink occlusion body 3. Therefore, the rear end portion of the pentip 2 is located in the front of the ink occlusion body 3.

Front Member

A front member 4 is a cylindrical body formed out of synthetic resin, for example, polypropylene or polyethylene by means of injection molding. The front member 4 includes: a small diameter portion 41 for holding an outer circumference of the pentip 2; and a large diameter portion 42, which is arranged at the rear of the small diameter portion 41 being connected to the small diameter portion 41, for holding an outer circumferential face of the front portion of the ink occlusion body 3.

On an inner face of the front member 4, that is, on an inner face of the small diameter portion 41 and on an inner face of the large diameter portion 42, a plurality of ribs 43, which extend in the longitudinal direction are integrally formed. In the rib 43, a step-shaped regulation wall portion 43*a* is formed in an intermediate portion of the front member 4 between the small diameter portion 41 and the large diameter portion 42. A front end portion of the ink occlusion body 3 comes into contact with the regulation wall portion 43*a* in the axial direction. A front outer circumferential face of the ink occlusion body 3 comes into pressure contact with the rib 43 on the inner face of the large diameter portion 42. Therefore, the front outer circumferential face of the ink occlusion body 3 is held by the rib 43 on the inner face of the large diameter portion 42. In the rib 43, an engaging protrusion 43*b* is formed on the inner face of the small diameter portion 41. On the inner face of the small diameter portion 41, an outer circumferential face of the pentip 2 is held by the rib 43 in the radial direction while the outer circumferential face of the pentip 2 is coming into pressure contact with the rib 43. At the same time, an annular groove 21 on the outer circumferential face of the pentip 2 is engaged with the engaging protrusion 43*b*. Therefore, a movement of the pentip 2 in the longitudinal direction is regulated.

By the rib 43, an air passage 10 can be formed between the outer circumferential face of the front portion of the ink occlusion body 3 and the inner face of the large diameter portion 42, between the front end face of the ink occlusion body 3 and the inner face of the intermediate portion of the front member 4 and between the outer circumferential face of the pentip 2 and the inner face of the small diameter portion 41. A front side of the air passage 10 is open outside from the front end portion of the front member 4. A rear side of the air passage 10 is communicated with the rear end face of the ink occlusion body 3. That is, both the front end face of the ink occlusion body 3 and the rear end face of the ink occlusion body 3 are communicated with the ambient air by the air passage 10.

Intermediate Member

The intermediate member 5 is a cylindrical body formed out of synthetic resin, for example, polypropylene or polyethylene by means of injection molding. The intermediate member 5 includes: a front cylindrical portion 51 which is open to the front; a partition wall 52 formed in a bottom portion of the front cylindrical portion 51; a rear cylindrical portion 53 which is extended from the partition wall 52 to the rear and is open to the rear; and a plurality of communication tubes 6, specifically two communication tubes 6 which are protruded forward from the front face of the partition wall 52 in the axial direction. In this embodiment, the partition wall 52 and the communication tubes 6 are integrated with each other into one body. Except for that, the partition wall 52 and the communication tubes 6, which are respectively formed out of different members, may be fixed to each other.

Onto the inner circumferential face of the front cylindrical portion 51, an outer circumferential face of the large diameter portion 42 of the front member 4 is press-fitted and fixed. In a space, that is, in the occlusion body accommodating portion formed by the front cylindrical portion 51, the partition wall 52 and the large diameter portion 42 of the front member 4, the ink occlusion body 3 is accommodated. An opening portion of the ink tank 7 is detachably attached to the rear cylindrical portion 53. Specifically, the opening portion of the ink tank 7 is detachably attached to the rear cylindrical portion 53 by means of screwing.

The partition wall 52 and the rear end face of the ink occlusion body 3 are maintained being not contacted with each other. Between the partition wall 52 and the rear end face of the ink occlusion body 3, a gap 9 communicating with the ambient air is formed. The gap 9 is communicated with the ambient air through the air passage 10.

Communication Tube

Inside each communication tube 6, a flow passage 62 is provided in the axial direction. The flow passage 62 is open at both end portions of each communication tube 6. A front end of each communication tube 6 is open to the front of the inside of the ink occlusion body 3. A rear end of each communication tube 6 is open to the ink tank 7 at the rear of the ink occlusion body 3. The front end of each communication tube 6 is a perpendicular face with respect to the axis. In the plurality of communication tubes 6, one communication tube 6*b* is protruded backward from the rear face of the partition wall 52 and the rear end of the communication tube 6*b* is located in the ink tank 7. On the other hand, the other communication tube 6*a* is not protruded backward from the rear face of the partition wall 52. That is, the rear end of the other communication tube 6*a* coincides with the rear face of the partition wall 52. The plurality of communication tubes 6 are arranged in parallel with each other between the ink occlusion body 3 and the ink tank 7. Therefore, between the ink occlusion body 3 and the ink tank 7 located at the rear of the ink occlusion body 3, a plurality of independent flow passages 62 are provided in parallel with each other.

The front end of each communication tube 6 is inserted into the ink occlusion body 3 while the front end of each communication tube 6 is piercing the ink occlusion body 3 from the rear end to the front. The last portion of each communication tube 6 is located at a position close to the rear end of the pentip 2 in the front of the inside of the ink occlusion body 3. When the front end of each communication tube 6 is inserted into the ink occlusion body 3, the front end of each communication tube 6 pushes and compresses forward the fiber of the ink occlusion body 3. Due to the foregoing, the fiber density of the ink occlusion body 3 close to the front end of each communication tube 6 is set higher than the fiber density of the ink occlusion body 3 of a portion except for the portion close to the front end of each communication tube 6. That is, in the ink occlusion body 3, the high density portion 31, the fiber density of which is high, and the low density portion 32, the fiber density of which is low, are formed. Since the front end of each communication tube 6 is located in the front of the inside of the ink occlusion body 3, the high density portion 31 is formed in the front of the inside of the ink occlusion body 3, and the low density portion 32 is formed at the rear of the inside of the ink occlusion body 3. Each communication tube 6 penetrates the low density portion 32 from the rear to the front. Therefore, the front end of each communication tube 6 is located at a position inside the high density portion 31 in the front of the low density portion 32. In this embodiment, the void ratio (the porosity) of the low density portion 32 is set at 85% to 93%. The void ratio of the high density portion 31 is set lower than that of the low density portion 32. A difference between the void ratio of the low density portion 32 and the void ratio of the high density portion 31 is set at 20%.

The front end portions of the communication tubes 6 are arranged at positions separate from the axial center of the ink occlusion body 3 outside in the radial direction. To be in more detail, the front end portions of the communication tubes 6 are arranged on the same circumference, which is formed round the axial center of the ink occlusion body 3, at regular intervals. Since the number of the communication tubes 6 is two in the present embodiment, the communication tubes 6 are arranged symmetrically with respect to the axial center of the ink occlusion body 3 by forming an angle 180° between the two communication tubes 6. Since the pentip 2 is located at the axial center of the ink occlusion body 3, the front end portions of the communication tubes 6 are not directly connected to the rear end of the pentip 2, that is, the front end portions of the communication tubes 6 are in a no-contact state with the pentip 2. Accordingly, the front end portions of the communication tubes 6 are connected so that ink can flow through the front portion of the inside of the ink occlusion body 3 (the high density portion 31). The front end portions of the communication tubes 6 are located at positions a little behind the rear end portion of the pentip 2. That is, the front end portions of the communication tubes 6 and the rear end portion of the pentip 2 are respectively connected to the high density portion 31 of the ink occlusion body 3.

Distance in the Axial Direction

In the present embodiment, length L in the axial direction of the entire ink occlusion body 3 is set at 30 mm. In the present embodiment, both distances S1 and S2 in the axial direction from the front end portion of the ink occlusion body 3 to the front end portions of the communication tubes 6 are set at 4 mm. Therefore, distances S1 and S2 in the axial direction from the front end portion of the ink occlusion body 3 to the front end portions of the communication tubes 6 are 13.3% (in the range from 3% to 50%) of length L in the axial direction of the entire ink occlusion body 3. In the present embodiment, both distances T1 and T2 in the axial direction from the front end portions of the communication tubes 6 to the rear end of the pentip 2 are set at 1 mm (not more than 10 mm).

Ink Tank

The ink tank 7 is a cylindrical body having a bottom, the front end of which is open and the rear end of which is closed. This ink tank 7 is formed out of synthetic resin by means of injection molding or blow molding. Ink 8 is directly stored in the ink tank 7. Ink 8 stored in the ink tank 7 may be either water-color ink or oil-based ink.

A front end opening portion of the ink tank 7 is detachably attached to the intermediate member 5. In the case where it become impossible to conduct writing because all ink 8 in the ink tank 7 has been consumed, the ink tank 7 is detached from the intermediate member 5 and then ink 8 is charged into the ink tank 7. Alternatively, the ink tank 7 is replaced with a new ink tank 7 into which ink 8 has already been charged. Then, the ink tank 7, into which ink 8 has already been charged, is attached to the intermediate member 5. Due to the foregoing, writing can be resumed.

The direct-fluid-supply writing implement 1 of the present embodiment includes a cap (not shown) which can be freely attached to and detached from the pentip 2 side. When the cap is attached to the pentip 2 side, the front end opening portions of the pentip 2 and the air passage 10 are airtightly closed. Therefore, communication of the ink tank 7 with the ambient air can be shut off.

In the present embodiment, volume V2 of the ink occlusion body 3 is set to be from 50 to 70% of volume V2 of a space defined among the ink tank 7 and the respective communication tubes 6.

Second Embodiment

Figure 3:
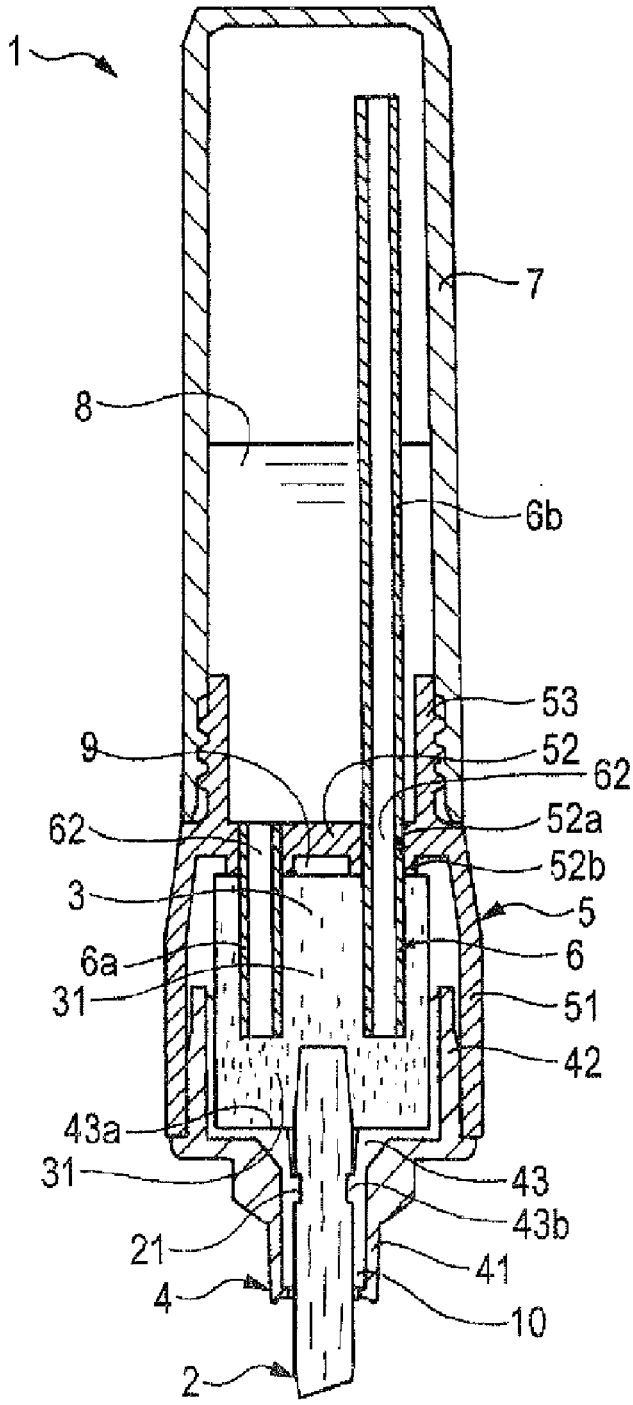
FIG. 3 is a longitudinal sectional view showing a state in which a pentip is directed downward of the second embodiment of the present invention.

FIG. 3 is a view showing the second embodiment of the present invention.

This embodiment is a variation of the first embodiment. Different points of this variation from the first embodiment are that the front end portion of the pentip 2 is formed into a chisel shape and that the communication tubes 6 and the partition wall 52 are formed out of different members.

On the partition wall 52, two attaching holes 52*a* are formed in the longitudinal direction. The communication tubes 6 are press-fitted and fixed into the attaching holes 52*a*. On a front face of the partition wall 52, an annular protrusion 52*b* (a contact wall portion), from which the attaching holes 52*a* are open to the front side, is integrally formed. The annular protrusion 52*b* and the rear end face of the ink occlusion body 3 are contacted with each other. Between the rear end face of the ink occlusion body 3 and the partition wall 52, a gap 9 corresponding to the protruding size of the annular protrusion 52*b* is appropriately formed. The front end face of the ink occlusion boy 3 comes into contact with a regulation wall portion 43*a*. Further, the rear end face of the ink occlusion body 3 comes into contact with the annular protrusion 52*b*. Due to the above structure, it is possible to prevent the generation of backlash in the longitudinal direction of the ink occlusion body 3. In this connection, the structure of this embodiment except for the above point is the same as that of the first embodiment. Therefore, the explanations are omitted here.

Third Embodiment

Figure 4:
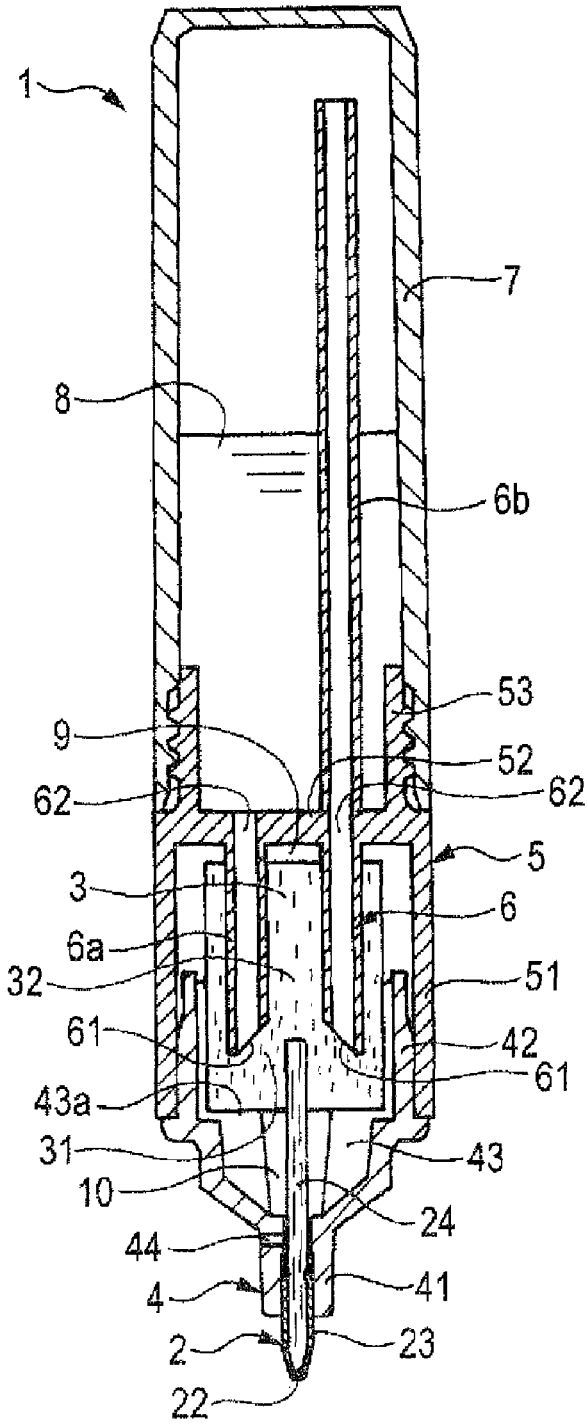
FIG. 4 is a longitudinal sectional view showing a state in which a pentip is directed downward of the third embodiment of the present invention.

FIG. 4 is a view showing the third embodiment of the present invention.

This embodiment is a variation of the first embodiment. The pentip 2 is composed of a ball-point-pen chip. The pentip 2 includes: a holder 23 for holding a ball 22 which is arranged at the forward end portion being capable of rotating; and an ink inducing member 24 attached in the holder 23. The ink inducing member 24 is formed out of a rod-shaped resin worked body made of synthetic resin fiber. A rear end portion of the ink inducing member 24 is inserted into the ink occlusion body 3 from the front end in such a manner that the rear end portion of the ink inducing member 24 pierces the ink occlusion body 3. Therefore, the rear end portion of the ink inducing member 24 is located at a position in the front of the inside of the ink occlusion body 3. On a side of the small diameter portion 41 of the front member 4, an air hole 44 is formed. An air communication passage 10 is formed between the ambient air and the front member 4 by this air hole 44.

A front end portion of each communication tube 6 is formed into an inclined cut face 61, that is, the front end portion of each communication tube 6 is sharpened. Due to the above structure, the piercing and inserting property of each communication tube 6 into the ink occlusion body 3 can be enhanced and further an opening area of the front end opening portion of each communication tube 6 is extended. Accordingly, ink can be quickly supplied into the ink occlusion body 3. The inclined cut face 61 of the front end of each communication tube 6 is formed so that the inclined cut face 61 can include the front end opening portion of each communication tube 6. The inclined cut face 61, that is, the front end opening portion of the communication tube 6 is directed to the axial center of the ink occlusion body 3, that is, in the direction of the rear end of the pentip 2. Due to the above structure, ink can be quickly supplied to the rear end of the pentip 2. Further, fiber in the vicinity of the rear end portion of the pentip 2 is pushed and compressed toward the rear end portion of the pentip 2 by the front end portion of the communication tube 6. Therefore, the fiber density in the vicinity of the rear end portion of the pentip 2 can be easily set at a high value. In the present embodiment, lateral cross-sections of the outer and inner faces of each communication tube 6 are circular. Outer and inner circumferential edges of the front end portion of each communication tube 6 are formed into an elliptical shape by the inclined cut face 61. In this connection, the structure of this embodiment except for the above structure is the same as that of the first embodiment. Therefore, the explanations are omitted here.

Fourth Embodiment

Figure 5:
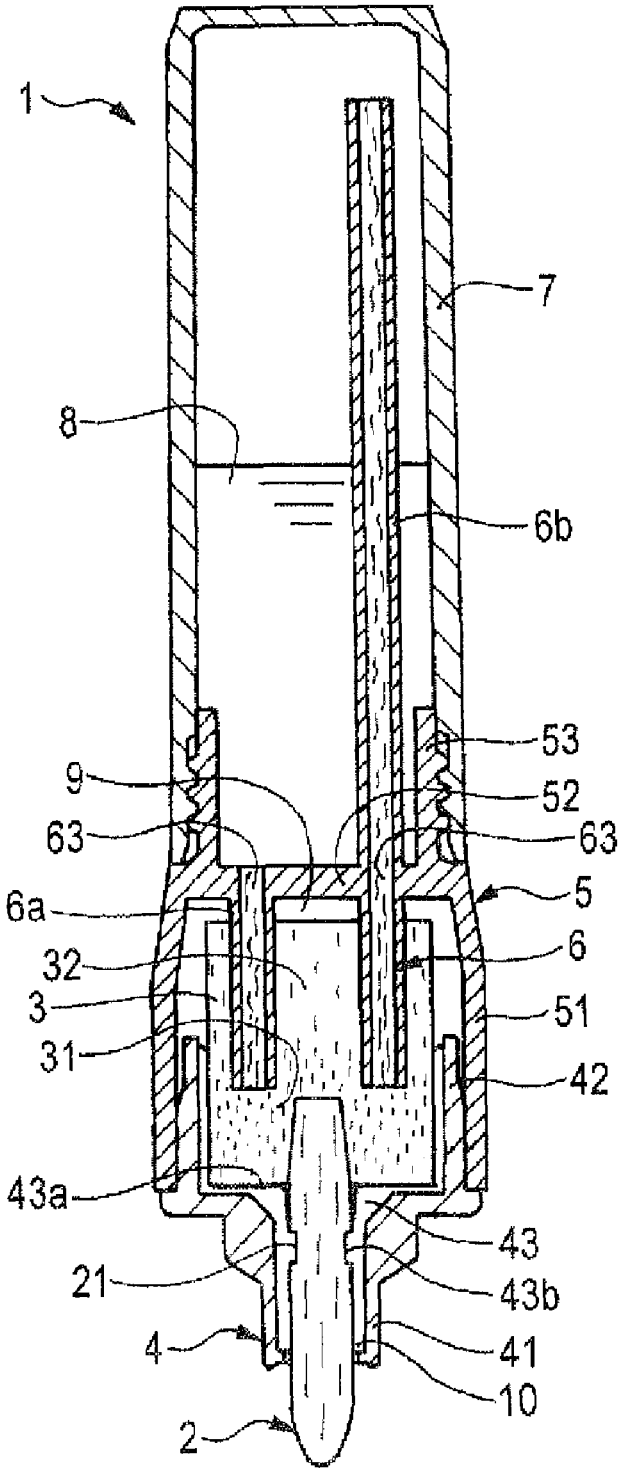
FIG. 5 is a longitudinal sectional view showing a state in which a pentip is directed downward of the fourth embodiment of the present invention.

FIG. 5 is a view showing the fourth embodiment of the present invention.

This embodiment is a variation of the first embodiment. A different point of this embodiment from the first embodiment is that an ink occlusion body 63 formed out of a fiber worked body is accommodated in a flow passage 62 of each communication tube 6. The fiber density (the capillary force) of the ink occlusion body 63 is set at a value lower than the fiber density (the capillary force) of the high density portion 31 of the ink occlusion body 3. Since the ink occlusion body 63 is accommodated in each communication tube 6, even when an outer diameter and an inner diameter of the communication tube 6 are set at a relatively high value, a front end opening portion of the communication tube 6 can be appropriately liquid-sealed. As a result, the outer diameter and the inner diameter of the communication tube 6 can be set high. Therefore, it is advantageous for preventing the communication tube 6 from being bent. In this connection, the structure of this embodiment except for the above structure is the same as that of the first embodiment. Therefore, the explanations are omitted here.

Fifth Embodiment

Figure 6:
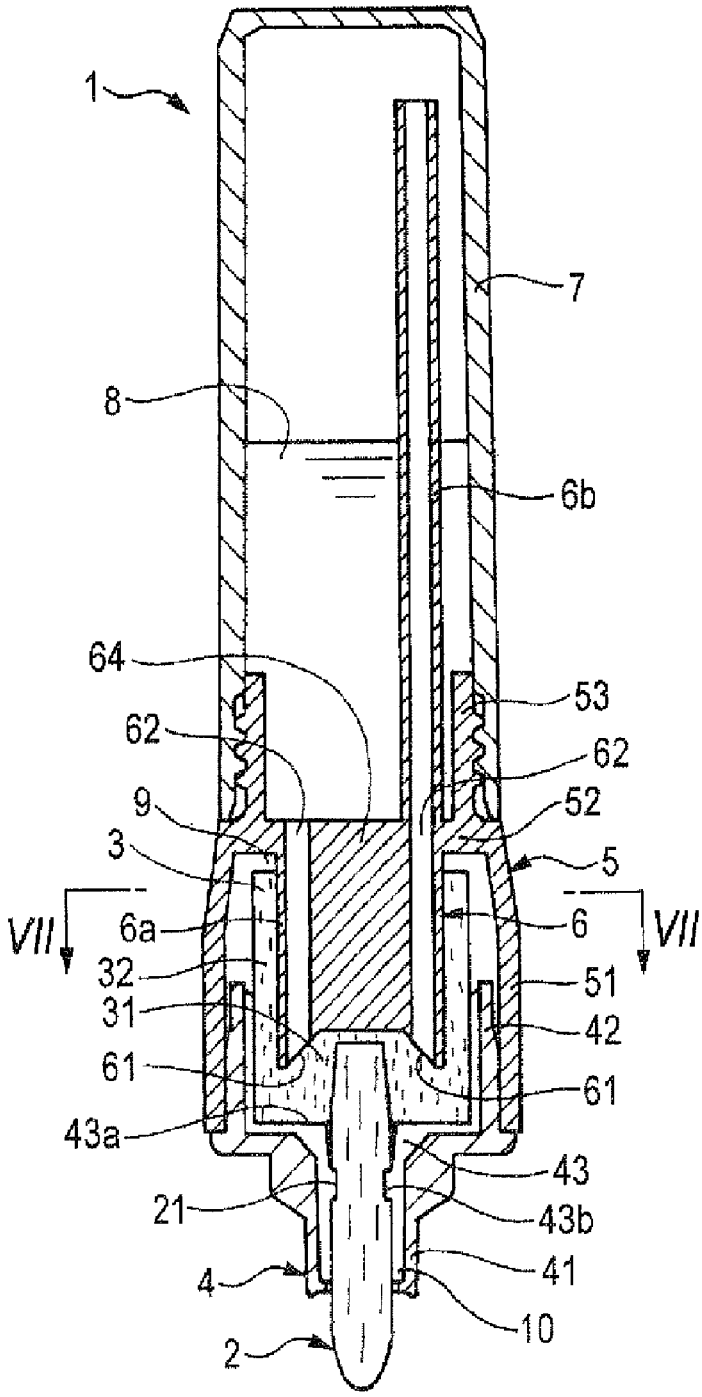
FIG. 6 is a longitudinal sectional view showing a state in which a pentip is directed downward of the fifth embodiment of the present invention.
Figure 7:
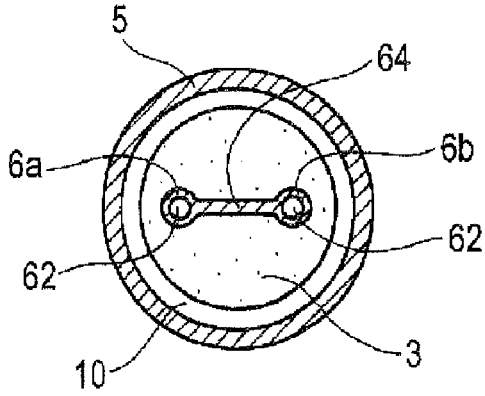
FIG. 7 is a sectional view taken on line VII-VII in FIG. 6.

FIGS. 6 and 7 are views showing the fifth embodiment of the present invention.

This embodiment is a variation of the first embodiment. Different point of this embodiment from the first embodiment are that the front end portion of each communication tube 6 is formed out of an inclined cut face 61, which is the same as the structure of the third embodiment, and that side walls of the communication tubes 6 are integrally connected to each other by a plate-shaped rib 64 extending in the axial direction. Since the side walls of the communication tubes 6 are integrally connected to each other by the plate-shaped rib 64 extending in the axial direction, the bending strength of each communication tube 6 is enhanced. Accordingly, each communication tube 6 can be stably inserted into the ink occlusion body 3 by piercing the communication tube 6. In this connection, the structure of this embodiment except for the above structure is the same as that of the first embodiment. Therefore, the explanations are omitted here.

Figure 8:
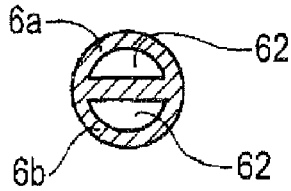
FIG. 8 is a lateral sectional view showing an example of another communication tube.

FIG. 8 is a view showing another example of the communication tube 6.

This is another example in which side walls of the communication tube 6 are connected to each other. That is, in this example, the inside of one cylindrical body is divided by a partition wall extending in the longitudinal direction. In other words, two communication tubes 6*a*, 6*b*, the lateral cross-sections of which are respectively formed into a crescent shape, are integrally connected to each other so that the lateral cross-section can be formed into a circle. Due to the above structure, two flow passages 62, the cross-sections of which are respectively formed into a crescent shape, are independently formed in parallel with each other inside the cylindrical body.

Figure 9:
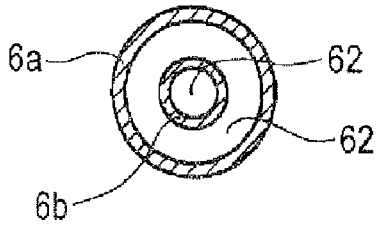
FIG. 9 is a lateral sectional view showing an example of another communication tube.

FIG. 9 is a view showing an example of another communication tuber 6. This is an example in which the communication tube 6*b*, the diameter of which is small, is arranged in the communication tube 6*a*, the diameter of which is large. In this example, between an inner circumferential face of the communication tube 6*a*, the diameter of which is large, and an outer circumferential face of the communication tube 6*b*, the diameter of which is small, a flow passage 62, the lateral cross-section of which is annular, is formed, and a flow passage 62, the lateral cross-section of which is circular, is formed in the communication tube 6*b*, the diameter of which is small. A rear end portion of the communication tube 6*a* of the large diameter is not protruded backward from a rear face of the partition wall 52. A rear end of the communication tube 6*b* of the small diameter is protruded backward from the rear face of the partition wall 52 and located in the ink tank 7.

Sixth Embodiment

Figure 10:
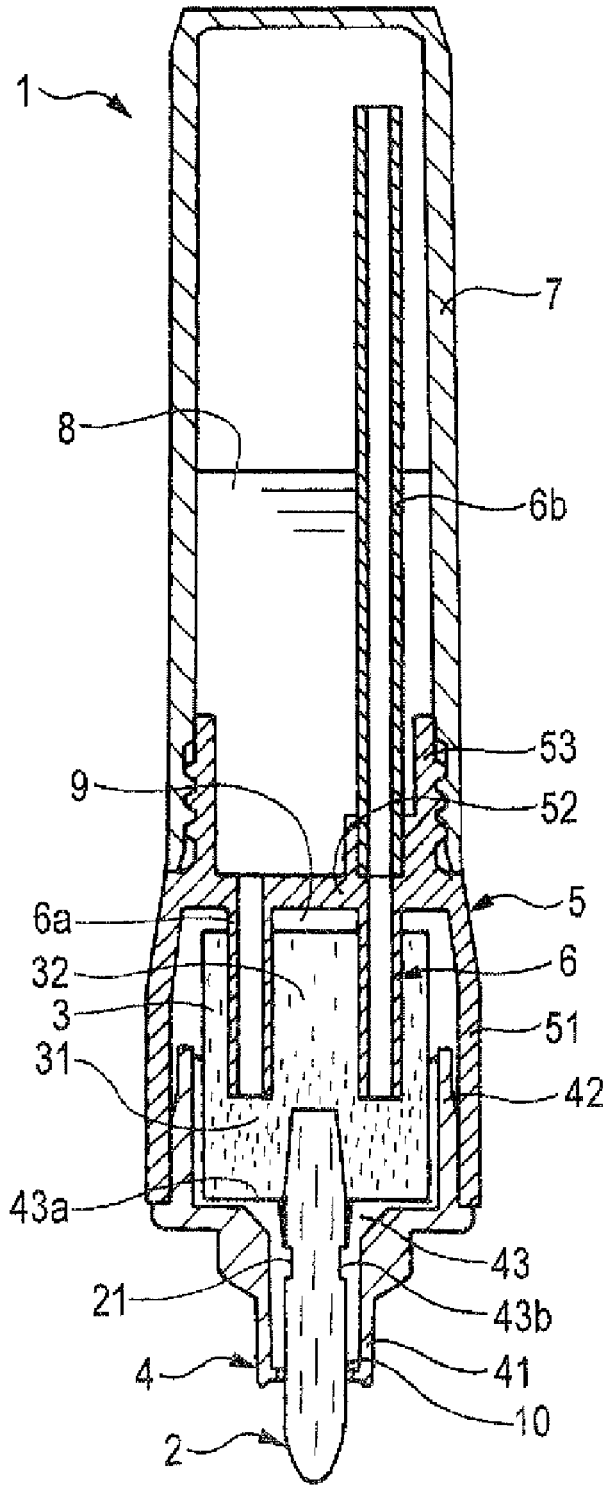
FIG. 10 is a longitudinal sectional view showing a state in which a pentip is directed downward of the sixth embodiment of the present invention.

FIG. 10 is a view showing the sixth embodiment of the present invention.

This embodiment is a variation of the first embodiment. Different points of this embodiment from the first embodiment are that the communication tube 6*b* protruded into the ink tank 7 is formed integrally with the partition wall 52 and that the communication tube 6*b* is formed out of two components including a first pipe-shaped member protruded forward from the front face of the partition wall 52 and also including a second pipe-shaped member protruded backward from the rear face of the partition wall 52. The second pipe-shaped member is press-fitted and fixed to the partition wall 52 and connected to the first pipe-shaped member so that the second pipe-shaped member can be communicated with the first pipe-shaped member. In this connection, the structure of this embodiment except for the above structure is the same as that of the first embodiment. Therefore, the explanations are omitted here.

Seventh Embodiment

Figure 11:
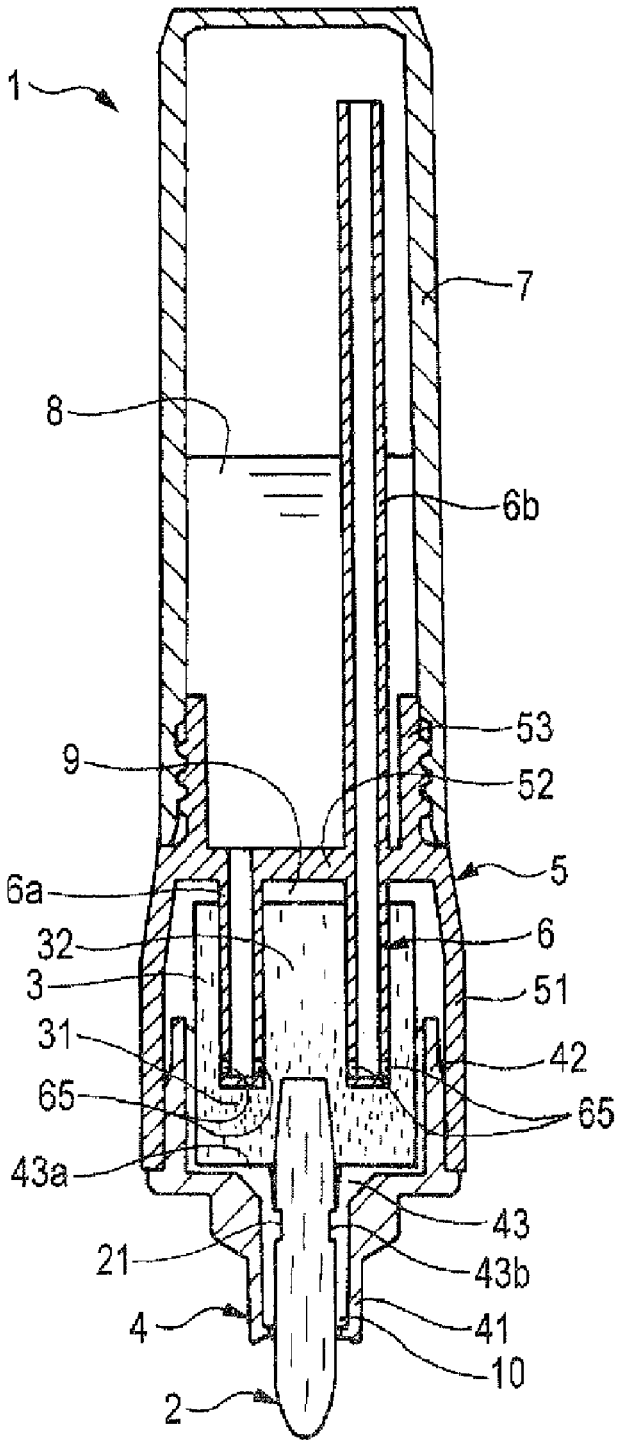
FIG. 11 is a longitudinal sectional view showing a state in which a pentip is directed downward of the seventh embodiment of the present invention.

FIG. 11 is a view showing the seventh embodiment of the present invention.

This embodiment is a variation of the first embodiment. A different point of this embodiment from the first embodiment is that front end portions of the communication tubes 6 are not open to the front in the axial direction but open outward in the radial direction by a plurality of windows 65. In this connection, the structure of this embodiment except for the above structure is the same as that of the first embodiment. Therefore, the explanations are omitted here.

Eighth Embodiment

Figure 12:
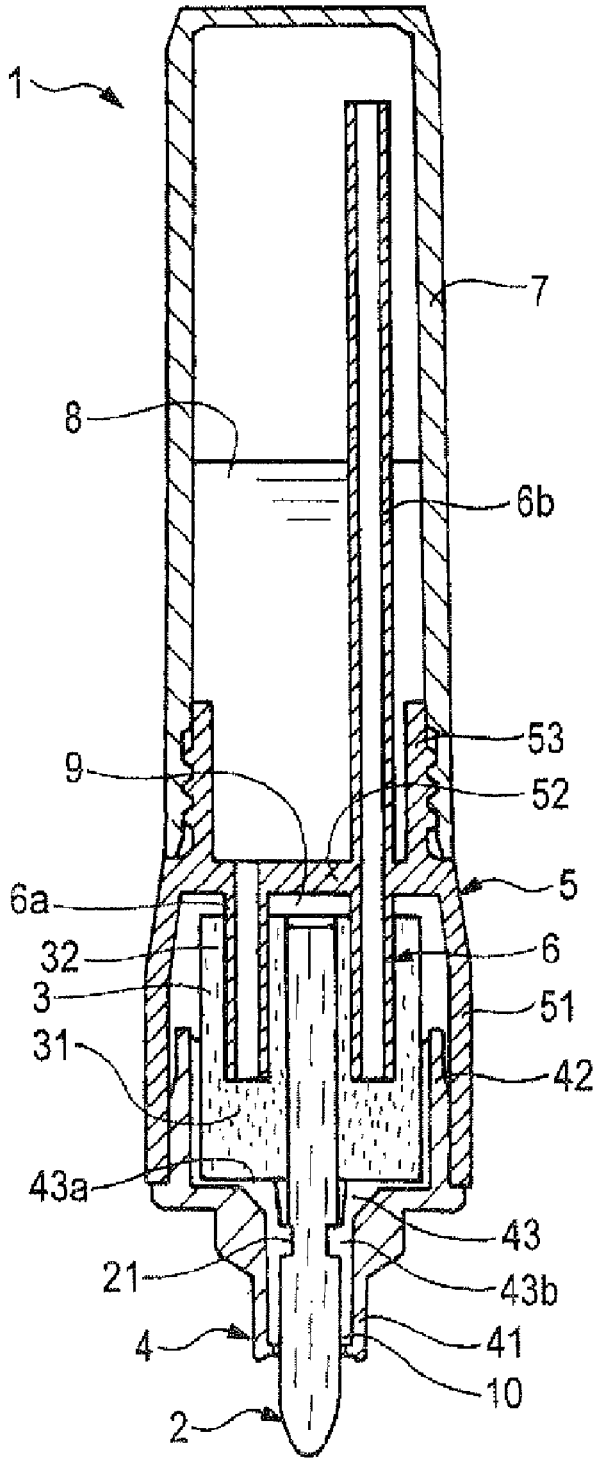
FIG. 12 is a longitudinal sectional view showing a state in which a pentip is directed downward of the eighth embodiment of the present invention.

FIG. 12 is a view showing the eighth embodiment of the present invention.

This embodiment is a variation of the first embodiment. A different point of this embodiment from the first embodiment is that the rear end portion of the pentip 2 is press-fitted into a through-hole formed at the axial center of the ink occlusion body 3 and located at a position at the rear of the inside of the ink occlusion body 3, that is, in an inner portion of the rear half of the ink occlusion body 3. In this connection, the structure of this embodiment except for the above structure is the same as that of the first embodiment. Therefore, the explanations are omitted here.

Ninth Embodiment

Figure 13:
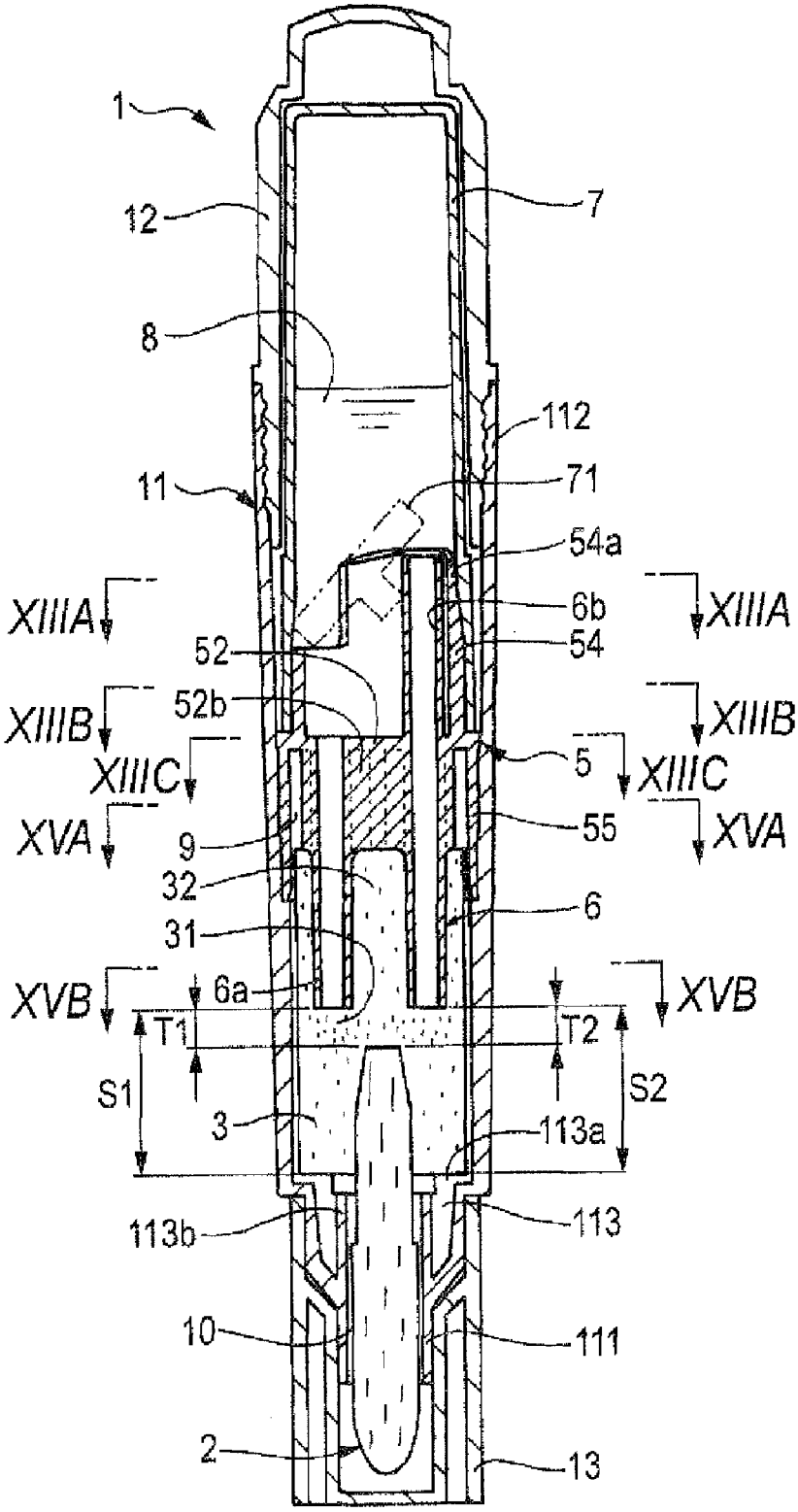
FIG. 13 is a longitudinal sectional view showing a state in which a pentip is directed downward of the ninth embodiment of the present invention.
Figure 14A:
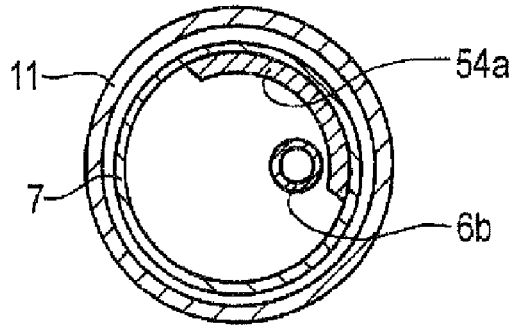
FIG. 14(A) is an enlarged sectional view taken on line XIIIA-XIIIA in FIG. 13.
Figure 14B:
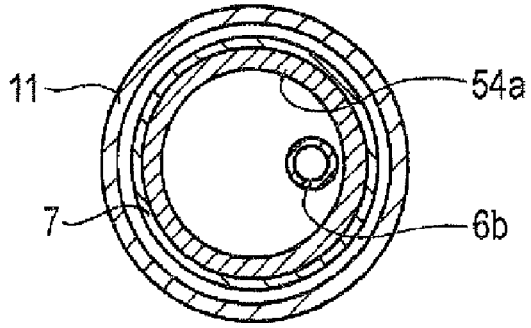
FIG. 14(B) is an enlarged sectional view taken on line XIIIB-XIIIB in FIG. 13.
Figure 14C:
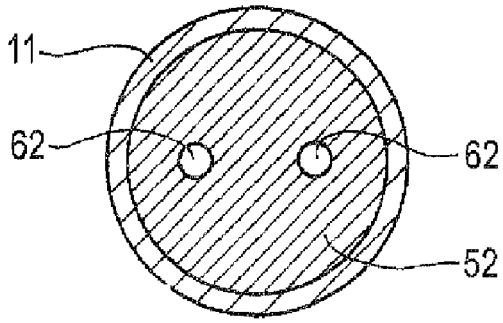
FIG. 14(C) is an enlarged sectional view taken on line XIIIC-XIIIC in FIG. 13.
Figure 15A:
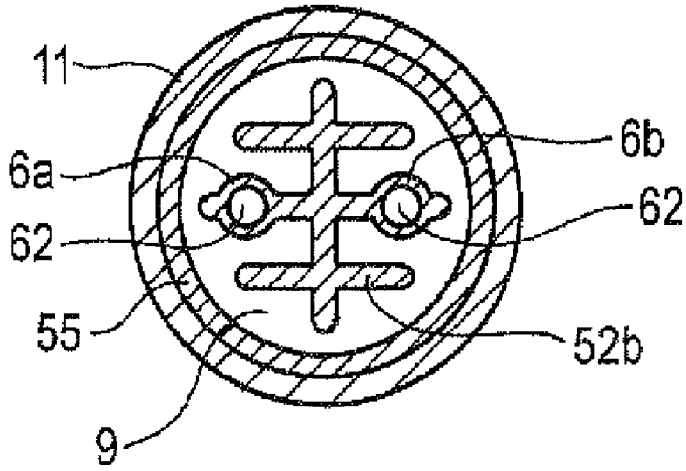
FIG. 15(A) is an enlarged sectional view taken on line XVA-XVA in FIG. 13.
Figure 15B:
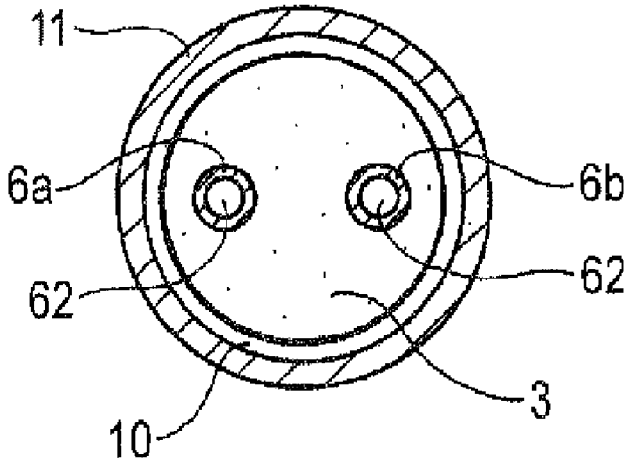
FIG. 15(B) is an enlarged sectional view taken on line XVB-XVB in FIG. 13.

A direct-fluid-supply writing implement 1 of the ninth embodiment of the present invention is shown in FIGS. 13 to 15.

The direct-fluid-supply writing implement 1 of the this embodiment includes: a pentip 2; an ink occlusion body 3 connected to a rear end of the pentip 2; an intermediate member 5 arranged at the rear of the ink occlusion body 3; an ink tank 7 arranged at the rear of the intermediate member 5; a barrel 11, the front end portion of which holds the pentip 2, for accommodating the ink occlusion body 3, the intermediate member 5 and the ink tank 7 inside; a tail plug 12 detachably screwed to rear end opening portion of the barrel 11; and a cap 13 detachably provided on the pentip 2 side.

Pentip

The pentip 2 is a rod-shaped body made of synthetic resin fiber such as polyester fiber, acrylic fiber or nylon fiber. A forward end portion of the pentip 2 is ground into a bullet-shape. An outer circumferential face of the rear end portion of the pentip 2 is chamfered being tapered.

Ink Occlusion Body

The ink occlusion body 3 is formed out of a columnar worked body made of synthetic resin fiber, for example, polyester fiber. An outer circumferential face of the ink occlusion body 3 is covered with cylindrical skin. The skin is formed out of a synthetic resin film, for example, a polyethylene terephthalate film. A rear end portion of the pentip 2 is inserted into an axial center of the front end face of the ink occlusion body 3 in such a manner that the rear end portion of the pentip 2 pierces the front end face of the ink occlusion body 3. Therefore, the rear end portion of the pentip 2 is located in the front of the ink occlusion body 3.

Barrel

The barrel 11 is a cylindrical body formed out of synthetic resin such as polypropylene or polyethylene by means of injection molding. The barrel 11 includes: a tapered portion 111 for holding an outer circumferential face of the pentip 2; and a main body portion 112, which is connected at the rear of the tapered portion 111, for accommodating the ink occlusion body 3, the partition wall 52 and the ink tank 7.

On an inner face of the barrel 11, that is, on an inner face of the tapered portion 111 and on an inner face of the main body portion 112, a plurality of ribs 113, which extend in the longitudinal direction are integrally formed. In the rib 113, a step-shaped regulation wall portion 113*a* is formed in the vicinity of the connecting portion between the tapered portion 111 of the barrel 11 and the main body portion 112. A front end face of the ink occlusion body 3 comes into contact with the regulation wall portion 113*a* in the axial direction. An outer circumferential face of the ink occlusion body 3 comes into pressure contact with the rib 113 on the inner face of the front portion of the main body portion 112. An outer circumferential face of the pentip 2 is press-fitted and held by the rib 113 on the inner face of the tapered portion 111. In the rib 113, between the portion for holding the outer circumferential face of the pentip 2 and the portion for holding the outer circumferential face of the ink occlusion body 3, a cylinder-like wall portion 113*b* is integrally formed.

By the rib 113, an air passage 10 is formed between the outer circumferential face of the ink occlusion body 3 and the inner face of the main body portion 112, between the front end face of the ink occlusion body 3 and the inner face of the barrel 11 and between the outer circumferential face of the pentip 2 and the inner face of the tapered portion 111. The front side of the air passage 10 is open to the outside from the front end portion of the barrel 11. Further, the rear side of the air passage 10 is communicated with the rear end face of the ink occlusion body 3. That is, the front end face and the rear end face of the ink occlusion body 3 are communicated with the ambient air by the air passage 10.

Intermediate Member

The intermediate member 5 is a cylindrical body formed out of synthetic resin, for example, polypropylene or polyethylene by means of injection molding. The intermediate member 5 includes: a partition wall 52 for dividing the ink occlusion body 3 and the ink tank 7; a plurality of communication tubes 6, specifically, two communication tubes 6 which are protruded forward from the front face of the partition wall 52 and pierced to the inside of the ink occlusion body 3; a connection tube 54 which is protruded from the rear face of the partition wall 52 and attached to the front opening portion of the ink tank 7; and an attaching cylinder 55 which is protruded in the axial direction from the front face of the partition wall 52 or the rear face and fixed to the inner face of the barrel 11 (the inner face of the main body portion 112). In a space formed by the barrel 11 and the partition wall 52, that is, in the ink occlusion body accommodating portion, the ink occlusion body 3 is accommodated. The attaching cylinder portion 55 surrounds an outer circumference of the base portion of each communication tube 6 in the front of the partition wall 52 or an outer circumference of the connecting tube 54. At the rear of the connection tube 54, a cutout portion is formed. By this cutout portion, a protruding piece 54*a* for pushing one side of the plug body 71 is formed at the rear of the connection tube 54. The partition wall 52 is a disk-shaped body. The communication tubes 6, the connecting tube 54 and the attaching cylindrical portion 55 are cylindrical bodies. A lateral cross-section of the protruding piece 54*a* is arcuate.

The partition wall 52, the communication tubes 6 (the communication tubes 6*a* and the communication tubes 6*b*), the connection tube 54 and the attaching cylinder 55 are arranged being integrated with each other into one body. That is, the partition wall 52, the communication tube 6, the connection tube 54 and the attaching cylindrical portion 55 compose one component by the intermediate member 5.

Contact Wall Portion

As shown in FIG. 15(A), on the front face of the partition wall 52, the contact wall portion 52*b*, which is formed out of a plate-shaped rib, is integrally formed. The contact wall portion 52*b* comes into contact with the rear end face of the ink occlusion body 3. Between the partition wall 52 and the rear end face of the ink occlusion body 3, a gap 9, which is communicated with the ambient air, is formed by the contact wall portion 52*b*. The gap 9 is communicated with the ambient air through the air passage 10. A portion of the contact wall portion 52*b* is formed between the base portions of the communication tubes 6. Therefore, the side walls of the base portions of the communication tubes 6 are connected to each other. Due to the foregoing, the bending strength of each communication tube 6 is enhanced. Therefore, each communication tube 6 can be prevented from being bent with respect to the partition wall 52. A lateral cross-section of the contact wall portion 52*b* is formed into a branch-shape, a radial-shape or a cross-shape.

Communication Tube

Inside each communication tube 6, a flow passage 62 is provided in the axial direction. The flow passage 62 is open at both end portions of each communication tube 6. A front end of each communication tube 6 is located inside the ink occlusion body 3 and open to the front of the inside of the ink occlusion body 3. A rear end of each communication tube 6 is open to the ink tank 7 at the rear of the ink occlusion body 3. In the plurality of communication tubes 6, one communication tube 6*b* is protruded backward from the rear face of the partition wall 52 and the rear end of the communication tube 6*b* is located in the ink tank 7 (in the connection tube 54). On the other hand, the other communication tube 6*a* is not protruded backward from the rear face of the partition wall 52. That is, the rear end of the other communication tube 6*a* coincides with the rear face of the partition wall 52. The communication tubes 6 are arranged in parallel with each other between the ink occlusion body 3 and the ink tank 7. Therefore, between the ink occlusion body 3 and the ink tank 7 located at the rear of the ink occlusion body 3, a plurality of independent flow passages 62 are provided in parallel with each other. The flow passage 62 of each communication tube 6 penetrates the partition wall 52 located in the connection tube 54 in a portion distant from the axial center.

A position in the longitudinal direction of the rear end portion of the communication tube 6*b* protruded backward from the rear end face of the partition wall 52 substantially coincides with the rear end of the connection tube 54, that is, the rear end of the protruding piece 54*a*. Alternatively, the position in the longitudinal direction of the rear end portion of the communication tube 6*b* is located at a position a little ahead the rear end portion of the connection tube 54, that is, the rear end of the protruding piece 54*a*. That is, the rear end of the communication tube 6*b*, which is protruded backward from the rear face of the partition wall 52, is not greatly protruded backward from the rear end of the connection tube 54, that is, the rear end of the protruding piece 54*a*. The communication tube 6*b*, which is protruded backward from the rear face of the partition wall 52, is arranged close to the inner face of the protruding piece 54*a*. Specifically, the communication tube 6*b*, which is protruded backward from the rear face of the partition wall 52, is arranged between the axial center of the connection tube 54 and the inner face of the protruding piece 54*a*.

The front end portion of each communication tube 6 is pierced and inserted from the rear end of the ink occlusion body 3 to the front and finally located at a position close to the rear end portion of the pentip 2 inside the ink occlusion body 3. When the front end of each communication tube 6 is inserted into the ink occlusion body 3, the front end of each communication tube 6 pushes and compresses forward the fiber of the ink occlusion body 3. Due to the foregoing, the fiber density of the ink occlusion body 3 close to the front end of each communication tube 6 is set higher than the fiber density of the ink occlusion body 3 of a portion except for the portion close to the front end of each communication tube 6. That is, in the ink occlusion body 3, the high density portion 31, the fiber density of which is high and the capillary force of which is strong, and the low density portion 32, the fiber density of which is low and the capillary force of which is weak, are formed. The high density portion 31 is formed in the front of the inside of the ink occlusion body 3, and the low density portion 32 is formed at the rear of the high density portion 31. The high density portion 31 and the low density portion 32 are connected to each other. Each communication tube 6 penetrates the low density portion 32 from the rear to the front. Therefore, the front end of each communication tube 6 is located at a position inside the high density portion 31 in the front of the low density portion 32. In this embodiment, the void ratio (the porosity) of the low density portion 32 is set at 85% to 93%. The void ratio of the high density portion 31 is set lower than that of the low density portion 32. A difference between the void ratio of the low density portion 32 and the void ratio of the high density portion 31 is set at 20%.

The front end portions of the communication tubes 6 are arranged at positions separate from the axial center of the ink occlusion body 3 outside in the radial direction. To be in more detail, the front end portions of the communication tubes 6 are arranged on the same circumference, which is formed round the axial center of the ink occlusion body 3, at regular intervals. Since the number of the communication tube 6 is two in the present embodiment, the communication tubes 6 are arranged symmetrically with respect to the axial center of the ink occlusion body 3 by forming an angle 180° between the two communication tubes 6. Since the pentip 2 is located at the axial center of the ink occlusion body 3, the front end portions of the communication tubes 6 are not directly connected to the rear end of the pentip 2, that is, the front end portions of the communication tubes 6 are in a no-contact state with the pentip 2. Accordingly, the front end portions of the communication tubes 6 are connected so that ink can flow through the front portion of the inside of the ink occlusion body 3 (the high density portion 31). The front end portions of the communication tubes 6 are located at positions a little behind the rear end portion of the pentip 2.

Distance in the Axial Direction

In the present embodiment, length L in the axial direction of the entire ink occlusion body 3 is set at 28 mm. In the present embodiment, both distances S1 and S2 in the axial direction from the front end portion of the ink occlusion body 3 to the front end portions of the communication tubes 6 are set at 14 mm. In the present embodiment, both distances T1 and T2 in the axial direction from the front end portions of the communication tubes 6 to the rear end of the pentip 2 are set at 3 mm (not more than 10 mm).

Ink Tank

The ink tank 7 is a cylindrical body having a bottom, the front end of which is open and the rear end of which is closed. This ink tank 7 is formed out of synthetic resin by means of injection molding or blow molding. Ink 8 is directly stored in the ink tank 7. Ink 8 stored in the ink tank 7 may be either water-color ink or oil-based ink.

An outer face of the connection tube 54 of the intermediate member 5 is detachably attached onto an inner face of the ink tank 7. In the case where it become impossible to conduct writing because all ink 8 in the ink tank 7 has been consumed, the ink tank 7 is detached from the connection tube 54 and then the connection tube 54 is attached to a front end opening portion of a new ink tank 7 into which ink 8 has been charged. Due to the foregoing, writing can be resumed. The front end opening portion of the above new ink tank 7 is closed with a plug body 71. Specifically, the plug body 71 is attached onto the inner face of the front end opening portion of the ink tank 7. When the connection tube 54 is inserted into the front end opening portion of the ink tank 7, one side of the plug body 71 is pushed backward by the protruding piece 54*a* of the connection tube 54 so as to detach the plug body 71. In this way, the plug body 71 is pulled out from the front end opening portion of the ink tank 7. In this case, the plug body 71 is a disk-shaped plug body 71 formed out of synthetic resin by means of injection molding. In this connection, it is possible to adopt a spherical plug body instead of the above disk-shaped plug body 71.

In the present embodiment, volume V2 of the ink occlusion body 3 is set to be from 50 to 70% of volume V2 of a space defined among the ink tank 7 and the respective communication tubes 6.

Cap

The cap 13 is detachably provided on the pentip 2 side. When the cap 13 is attached to the pentip 2 side, the front end opening portions of the pentip 2 and the air passage 10 are airtightly closed. Therefore, communication of the ink tank 7 with the ambient air can be shut off.

Tenth Embodiment

Figure 16:
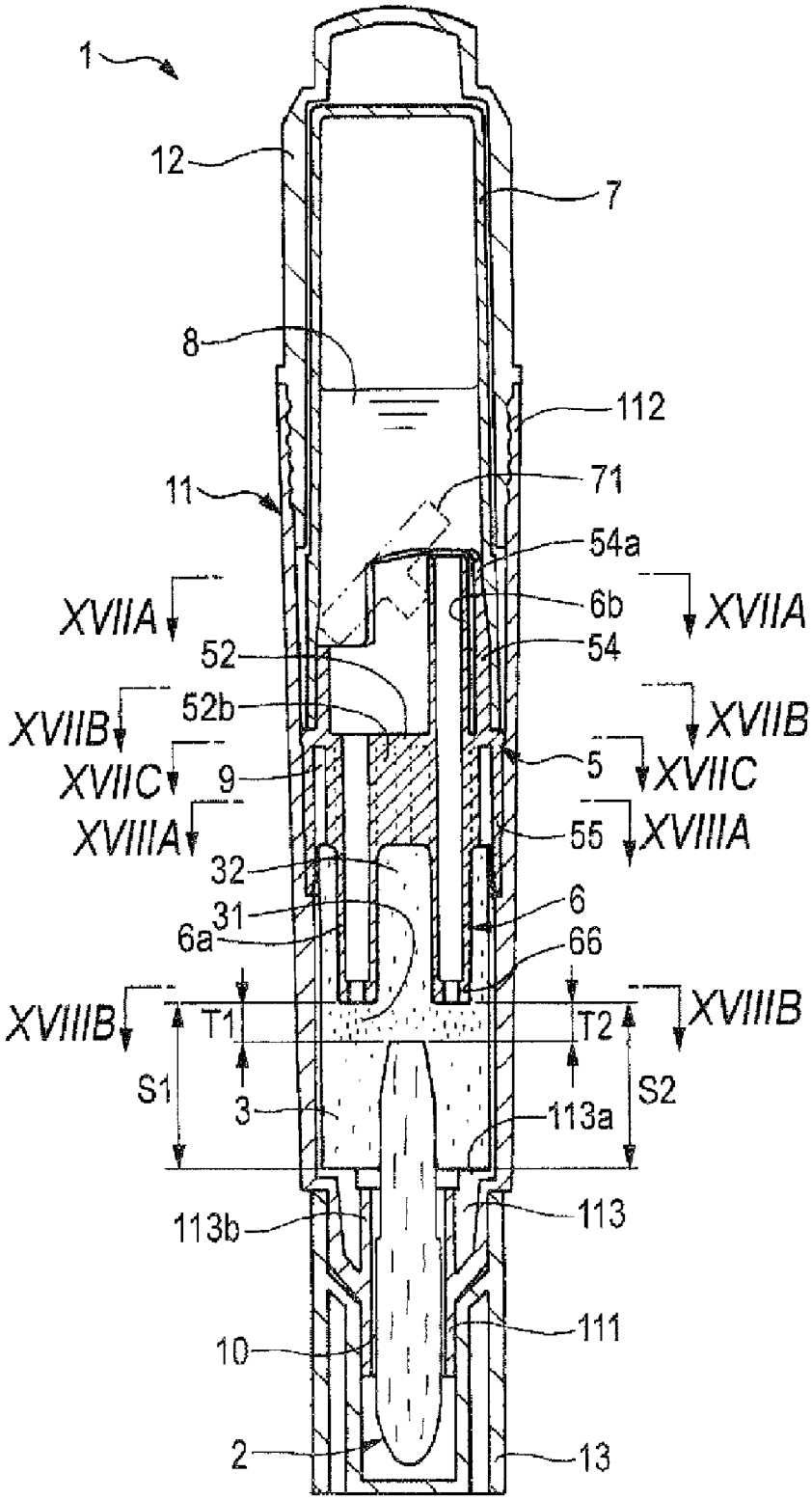
FIG. 16 is a longitudinal sectional view showing a state in which a pentip is directed downward of the tenth embodiment of the present invention.
Figure 17A:
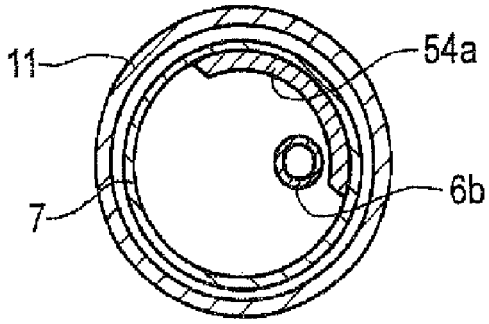
FIG. 17(A) is an enlarged sectional view taken on line XVIIA-XVIIA in FIG. 16.
Figure 17B:
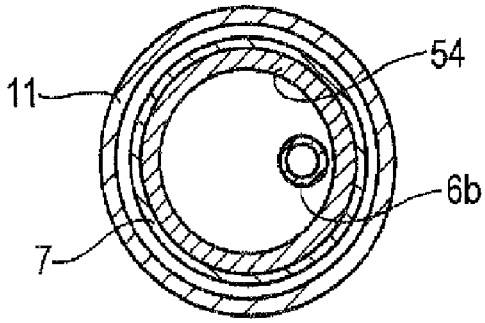
FIG. 17(B) is an enlarged sectional view taken on line XVIIB-XVIIB in FIG. 16.
Figure 17C:
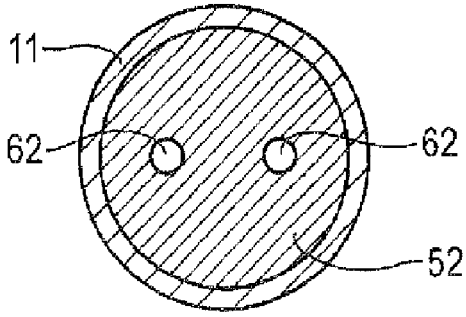
FIG. 17(C) is an enlarged sectional view taken on line XVIIC-XVIIC in FIG. 16.
Figure 18A:
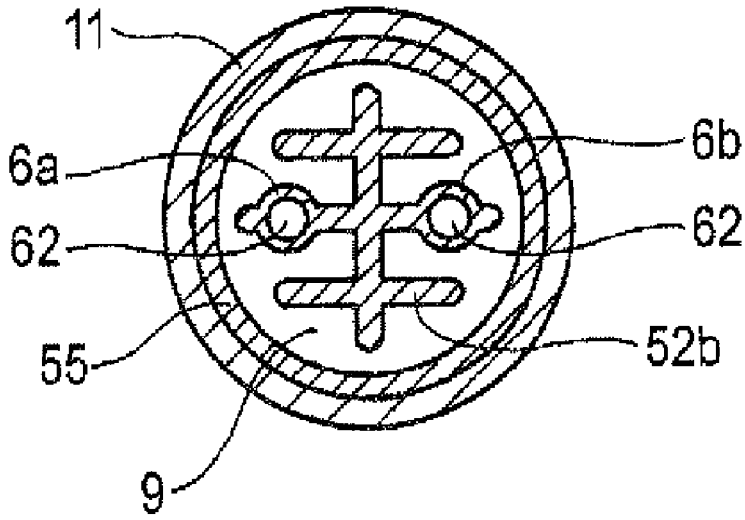
FIG. 18(A) is an enlarged sectional view taken on line XVIIIA-XVIIIA in FIG. 16.
Figure 18B:
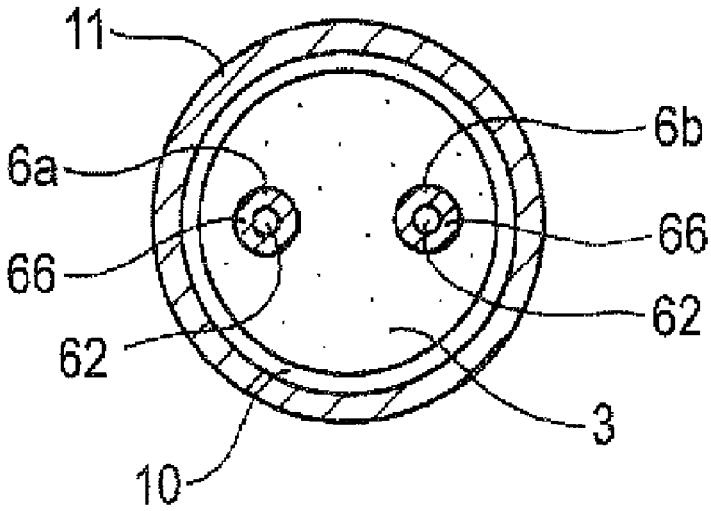
FIG. 18(B) is an enlarged sectional view taken on line XVIIIB-XVIIIB in FIG. 16.

FIGS. 16 to 18 are views showing a direct-fluid-supply writing implement 1 of the tenth embodiment of the present invention.

This embodiment is a variation of the ninth embodiment. A different point of this embodiment from the ninth embodiment is that a flow rate regulation portion 66 (an annular protruding portion) is provided on an inner face of the front end of each communication tube 6, specifically, on an inner face of the front end opening portion of each communication tube 6 which is open to the front in the axial direction. In the case where a sudden pressure change is generated while the pentip is being directed downward, it is possible to prevent ink 8 from blowing up outside from the ink tank 7 by this flow rate regulation portion 66. In this connection, the structure of this embodiment except for the above structure is the same as that of the ninth embodiment. Therefore, the explanations are omitted here.

Eleventh Embodiment

Figure 19:
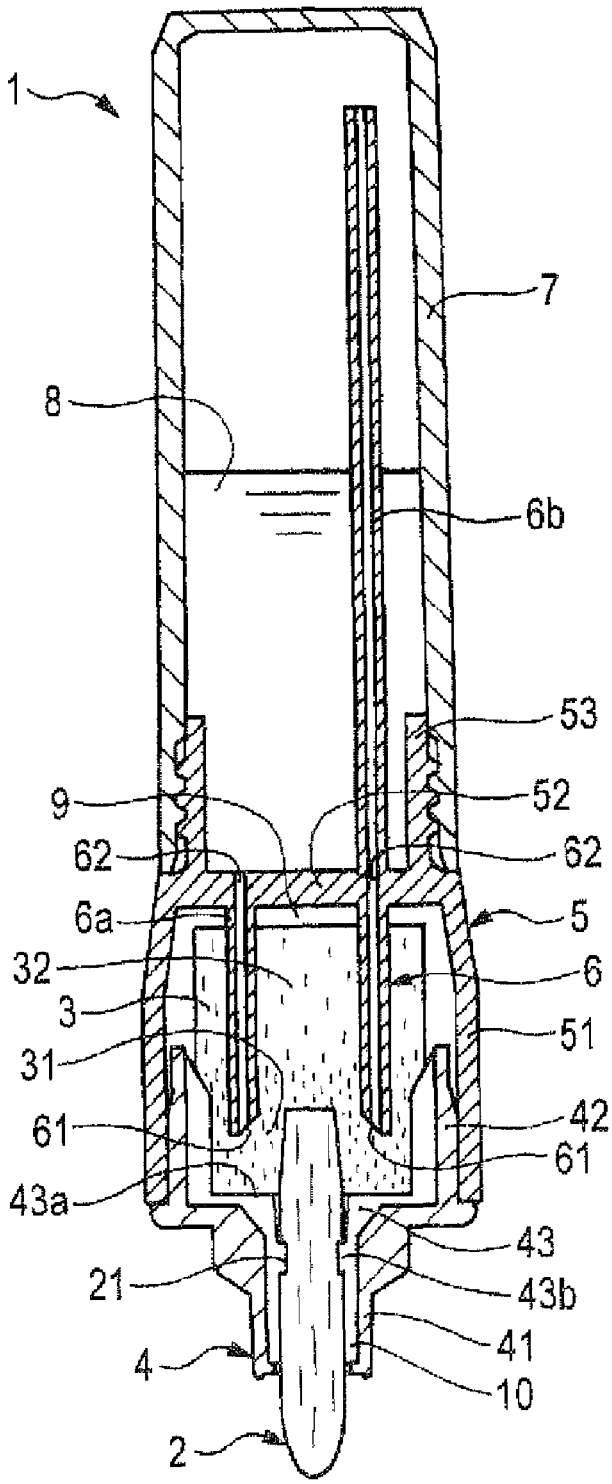
FIG. 19 is a longitudinal sectional view showing a state in which a pentip is directed downward of the eleventh embodiment of the present invention.

FIG. 19 is a view showing the eleventh embodiment of the present invention.

This embodiment is a variation of the first embodiment. Different points of this embodiment from the first embodiment are that the high density portion 31 is formed in the front portion of the ink occlusion body 3 by pushing and compressing an outer circumferential face of the front portion of the ink occlusion body 3 inward in the radial direction and that a front end portion of each communication tube 6 is sharpened, specifically, a front end face of each communication tube 6 is formed into an inclined cut face 61.

A plurality of ribs 43 formed on an inner face of the large diameter portion 42 of the front member 4 are composed in such a manner that a diameter of the inscribed circle of the ribs 43 is set at a value relatively smaller than an outer diameter of the front portion of the ink occlusion body 3. Before the ink occlusion body 3 is press-fitted into the front member 4, a density distribution in the longitudinal direction of the ink occlusion body 3 is uniform. When a front portion of the ink occlusion body 3 is press-fitted into the large diameter portion 42 of the front member 4, an outer circumferential face of the front portion of the ink occlusion body 3 is pushed and compressed by the ribs 43 described before. Due to the foregoing, the high density portion 31 is formed in the front portion of the ink occlusion body 3. At the rear of the high density portion 31, since the outer circumferential face of the ink occlusion body 3 is not compressed in the radial direction, the low density portion 32 is formed. Inward in the radial direction of the ribs 43 on the inner face of the large diameter portion 42, the front end portion of each communication tube 6 and the rear end of the pentip 2 are located. Therefore, the high density portion 31 can be appropriately formed in the vicinity of the front end of each communication tube 6 and in the vicinity of the rear end of the pentip 2.

A front end portion of each communication tube 6 is formed into an inclined cut face 61, that is, the front end portion of each communication tube 6 is sharpened. Due to the above structure, the piercing and inserting property of each communication tube 6 into the ink occlusion body 3 can be enhanced and further an opening area of the front end opening portion of each communication tube 6 is extended. Accordingly, ink can be quickly supplied into the ink occlusion body 3. The inclined cut face 61 of the front end of each communication tube 6 is formed so that the inclined cut face 61 can include the front end opening portion of each communication tube 6. The inclined cut face 61, that is, the front end opening portion of the communication tube 6 is directed to the axial center of the ink occlusion body 3, that is, in the direction of the rear end of the pentip 2. Due to the above structure, ink can be quickly supplied to the rear end of the pentip 2. Further, fiber in the vicinity of the rear end portion of the pentip 2 is pushed and compressed toward the rear end portion of the pentip 2 by the front end portion of the communication tube 6. Therefore, the fiber density in the vicinity of the rear end portion of the pentip 2 can be easily set at a high value. In the present embodiment, lateral cross-sections of the outer and inner faces of each communication tube 6 are circular in the same manner as that of the first embodiment. Outer and inner circumferential edges of the front end portion of each communication tube 6 are formed into an elliptical shape by the inclined cut face 61. In this connection, the structure of this embodiment except for the above structure is the same as that of the first embodiment. Therefore, the explanations are omitted here.

Twelfth Embodiment

Figure 20:
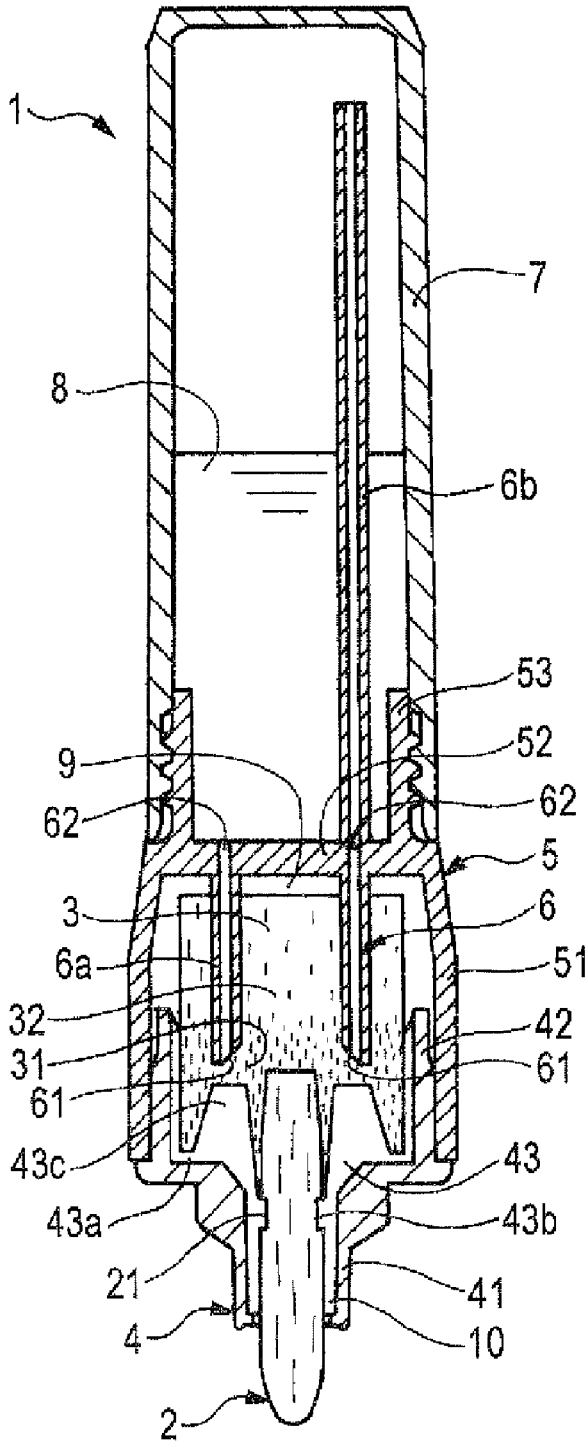
FIG. 20 is a longitudinal sectional view showing a state in which a pentip is directed downward of the twelfth embodiment of the present invention.

FIG. 20 is a view showing the twelfth embodiment of the present invention.

This embodiment is a variation of the first embodiment. Different points of this embodiment from the first embodiment are that the high density portion 31 is formed in the front portion of the ink occlusion body 3 by pushing and compressing a front end face of the ink occlusion body 3 backward and that a front end portion of each communication tube 6 is sharpened in the same manner as that of the eleventh embodiment, specifically, a front end face of each communication tube 6 is formed into an inclined cut face 61.

In the regulation wall portion 43*a* of the plurality of ribs 43 formed on the inner face of the front member 4, a protruding portion 43*c*, which is greatly protruded backward, is integrally formed. Before the ink occlusion body 3 is press-fitted into the front member 4, a density distribution of the ink occlusion body 3 is uniform. When the front portion of the ink occlusion body 3 is inserted into the large diameter portion 42 of the front member 4, the protruding portion 43*c* is deeply inserted onto the front end face of the ink occlusion body 3. Therefore, the front end face of the ink occlusion body 3 is pushed and compressed backward. Due to the foregoing, the high density portion 31 is formed in the front of the ink occlusion body 3. At the same time, since the outer circumferential face of the ink occlusion body 3 is not pushed and compressed, the low density portion 32 is formed at the rear of the high density portion 31. Since a rear end portion of the above protruding portion 43*c* is located in the vicinity of the front end of each communication tube 6 and in the vicinity of the rear end of the pentip 2, the high density portion 31 can be appropriately formed in the vicinity of the front end of each communication tube 6 and in the vicinity of the rear end of the pentip 2. In this connection, the structure of this embodiment except for the above structure is the same as that of the first embodiment. Therefore, the explanations are omitted here.

Thirteenth Embodiment

Figure 21:
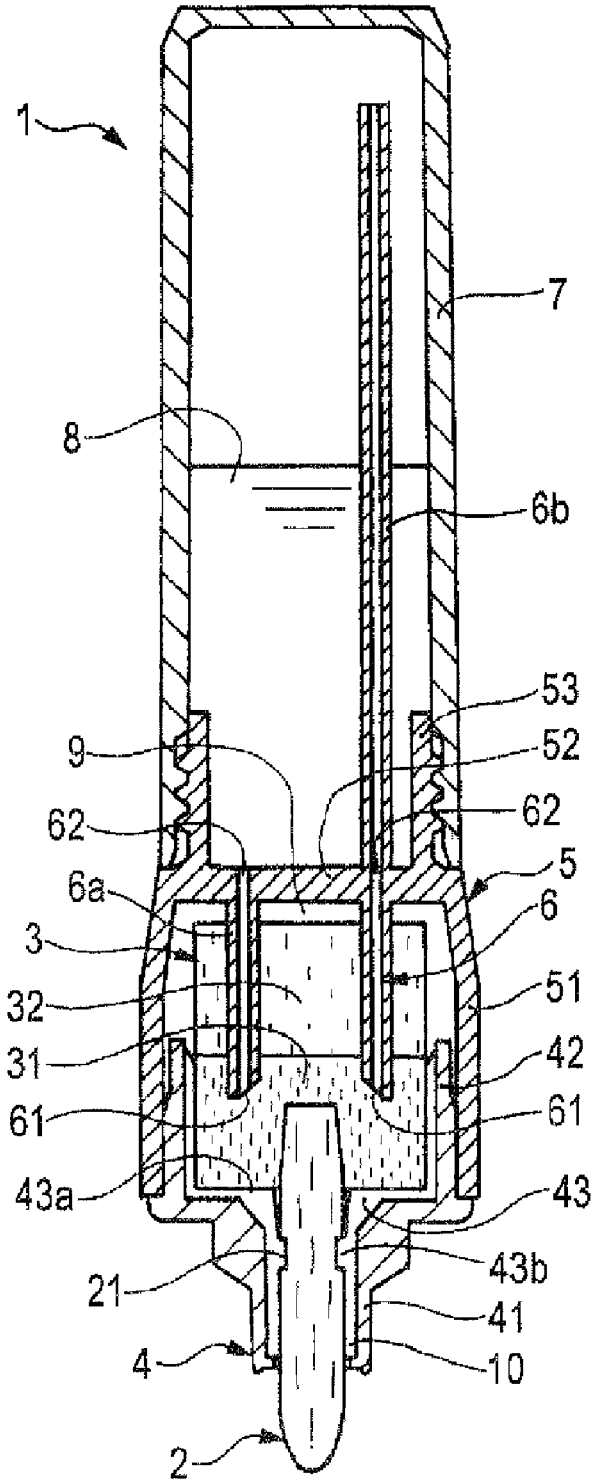
FIG. 21 is a longitudinal sectional view showing a state in which a pentip is directed downward of the thirteenth embodiment of the present invention.

FIG. 21 is a view showing the thirteenth embodiment of the present invention.

This embodiment is a variation of the first embodiment. Different points of this embodiment from the first embodiment are that the ink occlusion body 3 includes a first ink occlusion body to compose the high density portion 31 and a second ink occlusion body to compose the low density portion 32 and that the front end of each communication tube 6 is sharpened in the same manner as that of the second embodiment, specifically, the front end of each communication tube 6 is formed out of an inclined cut face 61.

Fiber density of the first ink occlusion body is previously set at a high value and fiber density of the second ink occlusion body is previously set at a value lower than the fiber density of the first ink occlusion body. A rear end face of the first ink occlusion body and a front end face of the second ink occlusion body are arranged coming into contact with each other. Each communication tube 6 penetrates the second ink occlusion body in the axial direction and the front end of each communication tube 6 is pierced into the first ink occlusion body from the rear to the front being connected to the first ink occlusion body. A rear end of the pentip 2 is pierced into the first ink occlusion body from the front to the rear being connected to the first ink occlusion body. Due to the foregoing, the high density portion 31 can be appropriately located in the vicinity of the front end of each communication tube 6 and in the vicinity of the rear end of the pentip 2. In this connection, the structure of this embodiment except for the above structure is the same as that of the first embodiment. Therefore, the explanations are omitted here.

Fourteenth Embodiment

Figure 22:
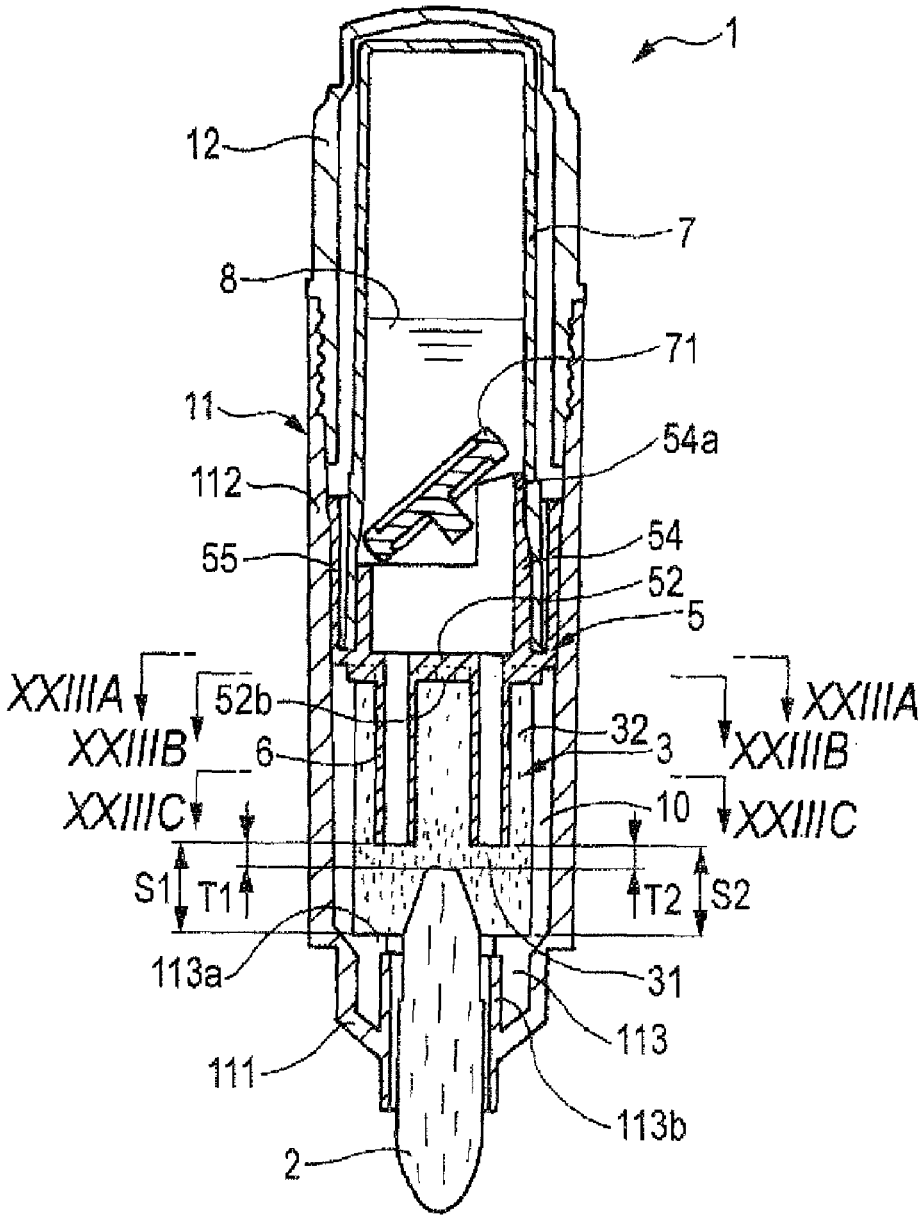
FIG. 22 is a longitudinal sectional view showing a state in which a pentip is directed downward of the fourteenth embodiment of the present invention.
Figure 23A:
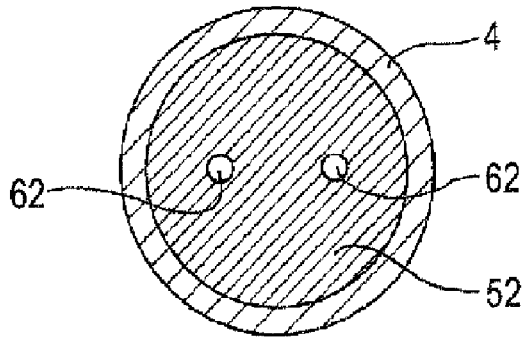
FIG. 23(A) is an enlarged sectional view taken on line XXIIIA-XXIIIA in FIG. 22.
Figure 23B:
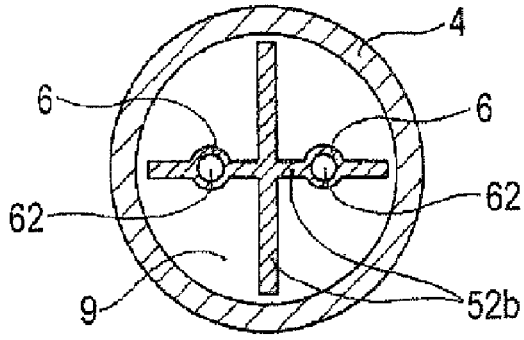
FIG. 23(B) is an enlarged sectional view taken on line XXIIIB-XXIIIB in FIG. 22.
Figure 23C:
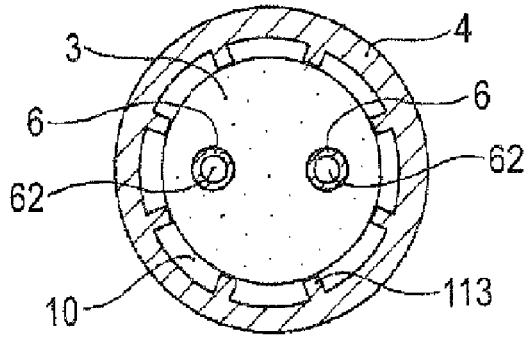
FIG. 23(C) is an enlarged sectional view taken on line XXIIIC-XXIIIC in FIG. 22.

A direct-fluid-supply writing implement 1 of the fourteenth embodiment of the present invention is shown in FIGS. 22 and 23.

The direct-fluid-supply writing implement 1 of the this embodiment includes: a pentip 2; an ink occlusion body 3 connected to a rear end of the pentip 2; an intermediate member 5 arranged at the rear of the ink occlusion body 3; an ink tank 7 arranged at the rear of the intermediate member 5; an barrel 11, the front end portion of which holds the pentip 2, for accommodating the ink occlusion body 3, the intermediate member 5 and the ink tank 7 inside; and a tail plug 12 detachably screwed to a rear end opening portion of the barrel 11.

Pentip

The pentip 2 is a rod-shaped body made of synthetic resin fiber such as polyester fiber, acrylic fiber or nylon fiber. A forward end portion of the pentip 2 is ground into a bullet-shape. An outer circumferential face of the rear end portion of the pentip 2 is chamfered being tapered.

Ink Occlusion Body

The ink occlusion body 3 is formed out of a columnar worked body made of synthetic resin fiber, for example, polyester fiber. An outer circumferential face of the ink occlusion body 3 is covered with cylindrical skin. The skin is formed out of a synthetic resin film, for example, a polyethylene terephthalate film. A rear end portion of the pentip 2 is inserted into an axial center of the front end face of the ink occlusion body 3 in such a manner that the rear end portion of the pentip 2 pierces the front end face of the ink occlusion body 3. Therefore, the rear end portion of the pentip 2 is located in the front of the ink occlusion body 3.

Barrel

The barrel 11 is a cylindrical body formed out of synthetic resin such as polypropylene or polyethylene by means of injection molding. The barrel 11 includes: a tapered portion 111 for holding an outer circumferential face of the pentip 2; and a main body portion 112, which is connected at the rear of the tapered portion 111, for accommodating the ink occlusion body 3, the partition wall 52 and the ink tank 7.

On an inner face of the barrel 11, that is, on an inner face of the tapered portion 111 and on an inner face of the main body portion 112, a plurality of ribs 113, which extend in the longitudinal direction are integrally formed. In the rib 113, a step-shaped regulation wall portion 113*a* is formed in the vicinity of the connecting portion between the tapered portion 111 of the barrel 11 and the main body portion 112. A front end face of the ink occlusion body 3 comes into contact with the regulation wall portion 113*a* in the axial direction. An outer circumferential face of the ink occlusion body 3 comes into pressure contact with the rib 113 on the inner face of the front portion of the main body portion 112. An outer circumferential face of the pentip 2 is press-fitted and held by the rib 113 on the inner face of the tapered portion 111. In the rib 113, between the portion for holding the outer circumferential face of the pentip 2 and the portion for holding the outer circumferential face of the ink occlusion body 3, a cylinder-like wall portion 113*b* is integrally formed.

By the rib 113, an air passage 10 is formed between the outer circumferential face of the ink occlusion body 3 and the inner face of the main body portion 112, between the front end face of the ink occlusion body 3 and the inner face of the barrel 11 and between the outer circumferential face of the pentip 2 and the inner face of the tapered portion 111. The front side of the air passage 10 is open to the outside from the front end portion of the barrel 11. Further, the rear side of the air passage 10 is communicated with the rear end face of the ink occlusion body 3. That is, the front end face and the rear end face of the ink occlusion body 3 are communicated with the ambient air by the air passage 10.

Intermediate Member

The intermediate member 5 is a cylindrical body formed out of synthetic resin, for example, polypropylene or polyethylene by means of injection molding. The intermediate member 5 includes: a partition wall 52 for dividing the ink occlusion body 3 and the ink tank 7; a plurality of communication tubes 6, specifically, two communication tubes 6 which are protruded forward from the front face of the partition wall 52 and pierced to the inside of the ink occlusion body 3; a connection tube 54 which is protruded from the rear face of the partition wall 52 and attached to the front opening portion of the ink tank 7; and an attaching cylinder 55 which is protruded backward from the rear face of the partition wall 52 and fixed to the inner face of the barrel 11 (the inner face of the main body portion 112). In a space formed by the barrel 11 and the partition wall 52, that is, in the ink occlusion body accommodating portion, the ink occlusion body 3 is accommodated. In the present embodiment, the attaching cylinder portion 55 surrounds an outer circumference of the base portion of the connection tube 54. In the connection tube 54, a protruding piece 54*a* for pushing one side of the plug body 71 is integrally provided. The partition wall 52 is a disk-shaped body. The communication tubes 6, the connecting tubes 54 and the attaching cylindrical portion 55 are cylindrical bodies.

The partition wall 52, the communication tubes 6, the connection tube 54 and the attaching cylinder 55 are arranged being integrated with each other into one body. That is, the partition wall 52, the communication tube 6, the connection tube 54 and the attaching cylindrical portion 55 compose one component by the intermediate member 5.

Contact Wall Portion

As shown in FIG. 23(B), on the front face of the partition wall 52, the contact wall portion 52*b*, which is formed out of a plate-shaped rib, is integrally formed. The contact wall portion 52*b* comes into contact with the rear end face of the ink occlusion body 3. Between the partition wall 52 and the rear end face of the ink occlusion body 3, a gap 9, which is communicated with the ambient air, is formed by the contact wall portion 52*b*. The gap 9 is communicated with the ambient air through the air passage 10. The contact wall portion 52*b* is provided so that the lateral cross-section can be formed into a radial shape (a cross shape). A portion of the contact wall portion 52*b* is formed between the base portions of the communication tubes 6 and communicated with the base portion side wall of each communication tube 6. Due to the foregoing, the bending strength of each communication tube 6 is enhanced. Therefore, each communication tube 6 can be prevented from being bent with respect to the partition wall 52.

Communication Tube

Inside each communication tube 6, a flow passage 62 is provided in the axial direction. The flow passage 62 is open at both end portions of each communication tube 6. A front end of each communication tube 6 is open to the front of the inside of the ink occlusion body 3. A rear end of each communication tube 6 is open to the ink tank 7 at the rear of the ink occlusion body 3. The communication tubes 6 are arranged in parallel with each other between the ink occlusion body 3 and the ink tank 7. Therefore, between the ink occlusion body 3 and the ink tank 7 located at the rear of the ink occlusion body 3, a plurality of independent flow passages 62 are provided in parallel with each other. The flow passage 62 of each communication tube 6 penetrates the partition wall 52 located in the connection tube 54 in a portion distant from the axial center.

The front end portion of each communication tube 6 is pierced and inserted from the rear end of the ink occlusion body 3 to the front and finally located at a position close to the rear end portion of the pentip 2 inside the ink occlusion body 3. When the front end of each communication tube 6 is inserted into the ink occlusion body 3, the front end of each communication tube 6 pushes and compresses forward the fiber of the ink occlusion body 3. Due to the foregoing, the fiber density of the ink occlusion body 3 close to the front end of each communication tube 6 is set higher than the fiber density of the ink occlusion body 3 of a portion except for the portion close to the front end of each communication tube 6. That is, in the ink occlusion body 3, the high density portion 31, the fiber density of which is high, and the low density portion 32, the fiber density of which is low, are formed. Since the front end of each communication tube 6 is located in the front of the inside of the ink occlusion body 3, the high density portion 31 is formed in the front of the inside of the ink occlusion body 3, and the low density portion 32 is formed at the rear of the high density portion 31. The high density portion 31 and the low density portion 32 are connected to each other. Each communication tube 6 penetrates the low density portion 32 from the rear to the front. Therefore, the front end of each communication tube 6 is located at a position inside the high density portion 31 in the front of the low density portion 32. In this embodiment, the void ratio (the porosity) of the low density portion 32 is set at 85% to 93%. A difference between the void ratio of the low density portion 32 and the void ratio of the high density portion 31 is set at 20%.

The front end portions of the communication tubes 6 are arranged at positions separate from the axial center of the ink occlusion body 3 outside in the radial direction. To be in more detail, the front end portions of the communication tubes 6 are arranged on the same circumference, which is formed round the axial center of the ink occlusion body 3, at regular intervals. Since the number of the communication tubes 6 is two in the present embodiment, the communication tubes 6 are arranged symmetrically with respect to the axial center of the ink occlusion body 3 by forming an angle 180° between the two communication tubes 6. Since the pentip 2 is located at the axial center of the ink occlusion body 3, the front end portions of the communication tubes 6 are not directly connected to the rear end of the pentip 2, that is, the front end portions of the communication tubes 6 are in a no-contact state with the pentip 2. Accordingly, the front end portions of the communication tubes 6 are connected so that ink can flow through the front portion of the inside of the ink occlusion body 3 (the high density portion 31). The front end portions of the communication tubes 6 are located at positions a little behind the rear end portion of the pentip 2.

Distance in the Axial Direction

In the present embodiment, length L in the axial direction of the entire ink occlusion body 3 is set at 30 mm. In the present embodiment, both distances S1 and S2 in the axial direction from the front end portion of the ink occlusion body 3 to the front end portions of the communication tubes 6 are set at 4 mm. Therefore, a distance S1, S2 in the axial direction from the front end portion of the ink occlusion body 3 to the front end portion of each communication tube 6 is set at 13.3% (in the range from 3% to 50%) of the length L in the axial direction of the entire ink occlusion body 3. In the present embodiment, both distances T1 and T2 in the axial direction from the front end portions of the communication tubes 6 to the rear end of the pentip 2 are set at 1 mm (not more than 10 mm).

Ink Tank

The ink tank 7 is a cylindrical body having a bottom, the front end of which is open and the rear end of which is closed. This ink tank 7 is formed out of synthetic resin by means of injection molding or blow molding. Ink 8 is directly stored in the ink tank 7. Ink 8 stored in the ink tank 7 may be either water-color ink or oil-based ink.

An outer face of the connection tube 54 of the intermediate member 5 is detachably attached onto an inner face of the ink tank 7. In the case where it become impossible to conduct writing because all ink 8 in the ink tank 7 has been consumed, the ink tank 7 is detached from the connection tube 54 and then the connection tube 54 is attached to a front end opening portion of a new ink tank 7 into which ink 8 has been charged. Due to the foregoing, writing can be resumed. The front end opening portion of the above new ink tank 7 is closed with a plug body 71. When the connection tube 54 is inserted into the front end opening portion of the ink tank 7, one side of the plug body 71 is pushed backward by the protruding piece 54*a* of the connection tube 54 so as to detach the plug body 71. In this way, the plug body 71 is pulled out from the front end opening portion of the ink tank 7.

In the present embodiment, the volume V2 of the ink occlusion body is set to be from 50% to 70% of the volume V1 of the space defined between the ink tank 7 and the respective communication tube 6.

In the present embodiment, the volume V2 of the ink occlusion body is set to be from 50% to 70% of the volume V1 of the space defined between the ink tank 7 and the respective communication tube 6.

Fifteenth Embodiment

Figure 24:
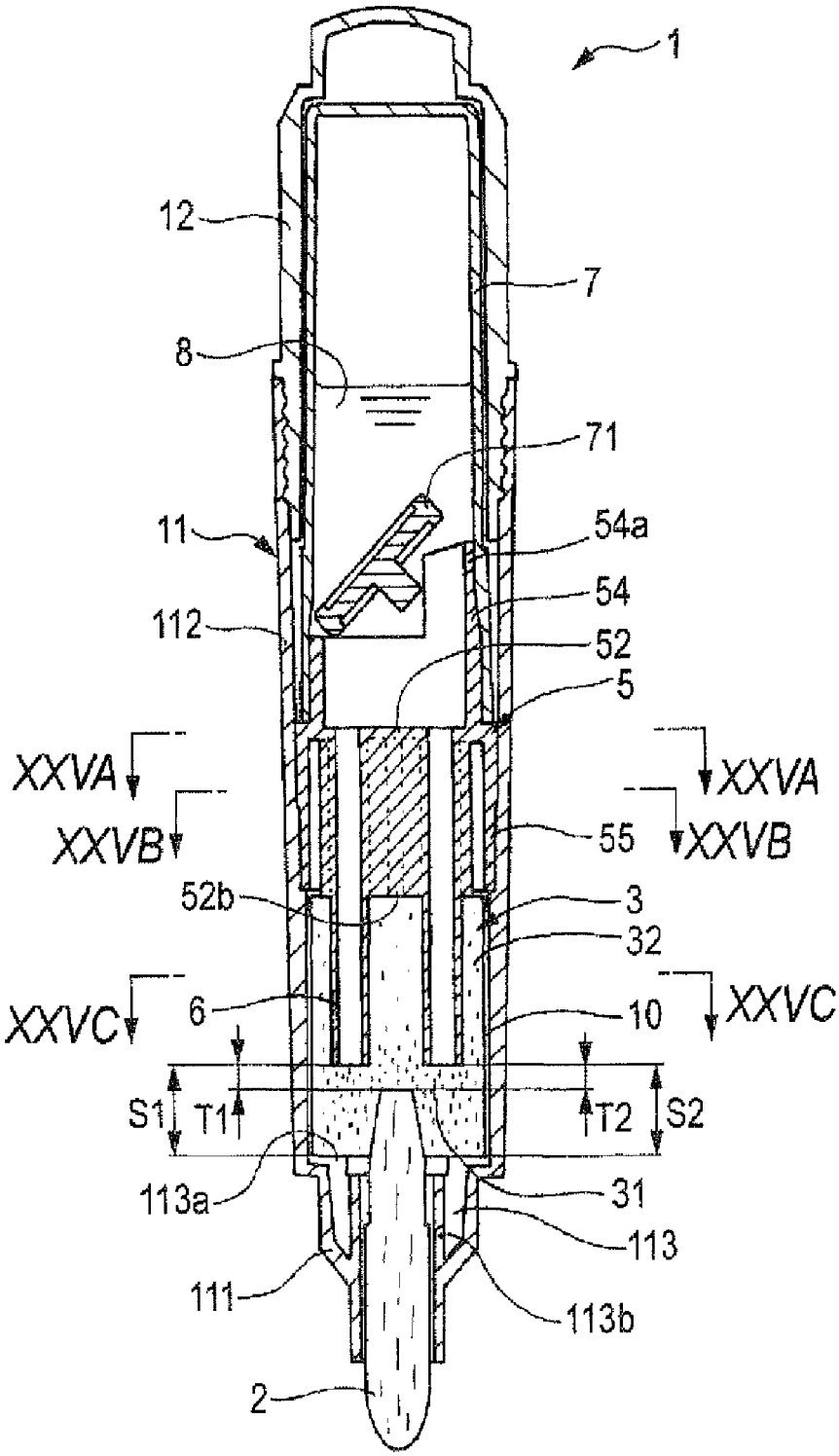
FIG. 24 is a longitudinal sectional view showing a state in which a pentip is directed downward of the fifteenth embodiment of the present invention.
Figure 25A:
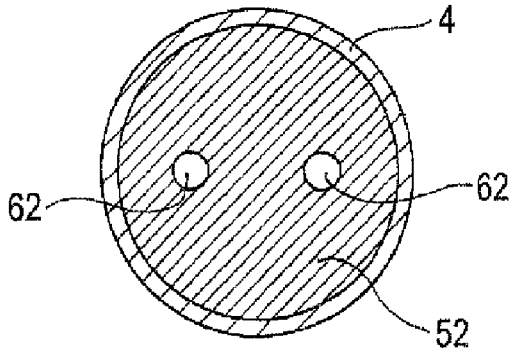
FIG. 25(A) is an enlarged sectional view taken on line XXVA-XXVA in FIG. 24.
Figure 25B:
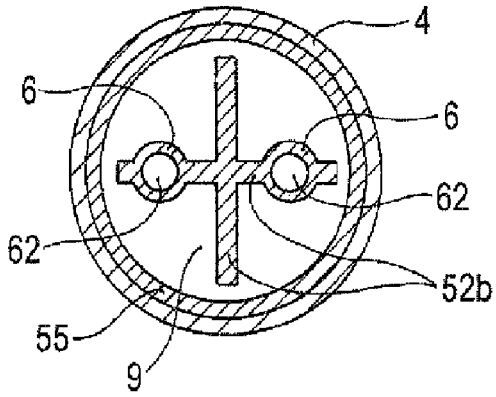
FIG. 25(B) is an enlarged sectional view taken on line XXVB-XXVB in FIG. 24.
Figure 25C:
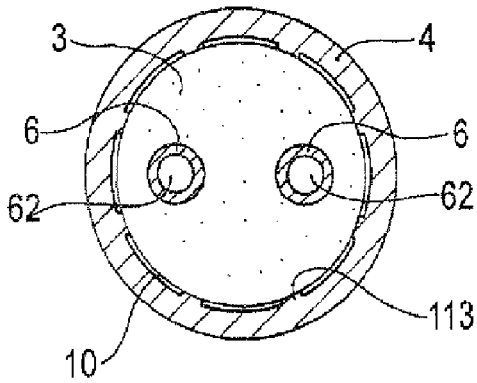
FIG. 25(C) is an enlarged sectional view taken on line XXVC-XXVC in FIG. 24.

FIGS. 24 and 25 are views showing the fifteenth embodiment of the present invention.

This embodiment is a variation of the fourteenth embodiment. Different points of this embodiment from the fourteenth embodiment are that the attaching cylindrical portion 55 protrudes forward from the front face of the partition wall 52 and surrounds the base portion of each communication tube 6 and that the contact wall portion 52*b* greatly protrudes forward from the front face of the partition wall 52. Especially when a length in the axial direction of the contact wall portion 52*b* is adjusted, the writing instrument body can be arbitrarily set at a length in the axial direction so that the writing instrument body can be easily held. Therefore, it is unnecessary to change a length of the ink tank 7 in the axial direction, that is, it is unnecessary to change a capacity of the ink tank. Further, it is unnecessary to change a length of the ink occlusion body 3 in the axial direction. In this connection, the structure of this embodiment except for the above structure is the same as that of the fourteenth embodiment. Therefore, the explanations are omitted here.

While the invention has been described in connection with the exemplary embodiments, it will be obvious to those skilled in the art that various changes and modification may be made therein without departing from the present invention, and it is aimed, therefore, to cover in the appended claim all such changes and modifications as fall within the true spirit and scope of the present invention.

What is claimed is:

1. A direct-fluid-supply writing implement comprising:

a pentip;

an ink occlusion body connected to a rear end of the pentip;

an ink tank that directly stores ink and is arranged at a rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, and at least one of the communication tubes is provided such that a rear end of the communication tube is protruded backward from a rear face of the partition wall and is located inside the ink tank, and another of the communication tubes is not protruded backward from a rear face of the partition wall.

2. The direct-fluid-supply writing implement according to claim 1, wherein positions of the forward end portions of the communication tubes in the axial direction are set equally to each other.

3. The direct-fluid-supply writing implement according to claim 1, wherein the forward end portions of the communication tubes are located at positions close to the rear end portion of the pentip in the ink occlusion body.

4. The direct-fluid-supply writing implement according to claim 1, wherein the forward end portions of the communication tubes are located at positions in the front of the inside of the ink occlusion body, and the rear end portion of the pentip is located in a front side of the inside of the ink occlusion body.

5. The direct-fluid-supply writing implement according to claim 1, wherein a rear end portion of the pentip and the forward end portions of the communication tubes are connected to each other so that the ink flows therebetween through the ink occlusion body.

6. A direct-fluid-supply writing implement comprising:

a pentip;

an ink occlusion body connected to a rear end of the pentip;

an ink tank that directly stores ink and is arranged at a rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, and at least one of the communication tubes is provided such that a rear end of the communication tube is protruded backward from a rear face of the partition wall and is located inside the ink tank, wherein the forward end portions of the communication tubes are inserted from the rear of the ink occlusion body to the front so as to push and compress the inside of the ink occlusion body to the front, so that density of the ink occlusion body in a vicinity of the forward end portions of the communication tubes is set to be higher than density of the ink occlusion body in a portion except for the vicinity of the forward end portions of the communication tubes.

7. A direct-fluid-supply writing implement comprising:

a pentip;

an ink occlusion body connected to a rear end of the pentip;

an ink tank that directly stores ink and is arranged at a rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, and at least one of the communication tubes is provided such that a rear end of the communication tube is protruded backward from a rear face of the partition wall and is located inside the ink tank, wherein a front end opening portion of the ink tank before the opening portion is opened is closed with a plug body, a connection tube is protruded backward from a rear face of the partition wall, the connection tube is attached to the inside of the front end opening portion of the ink tank, the connection tube pushes the plug body so as to open the ink tank, the communication tube protruded backward from the rear face of the partition wall is located inside the connection tube, and the rear end of the communication tube protruded backward from the rear face of the partition wall is located at a position in a front portion of the rear end of the connection tube, or alternatively, a position in an axial direction of the rear end portion of the communication tube protruded backward from the rear face of the partition wall and a position in the axial direction of the rear end portion of the connection tube substantially coincide with each other.

8. The direct-fluid-supply writing implement according to claim 7, wherein a protruding piece for pushing one side of the plug body at the time of opening the ink tank is arranged on one side at the rear of the connection tube, and an outer face of the communication tube protruded backward from the rear face of the partition wall and an inner face of the protruding piece are made to come close to each other.

9. A direct-fluid-supply writing implement comprising:

a pentip;

an ink occlusion body connected to a rear end of the pentip;

an ink tank that directly stores ink and is arranged at a rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, and at least one of the communication tubes is provided such that a rear end of the communication tube is protruded backward from a rear face of the partition wall and is located inside the ink tank, wherein the ink occlusion body includes a high density portion and a low density portion connected at the rear of the high density portion, and the forward end portions of the communication tubes and the rear end of the pentip are located in the high density portion.

10. The direct-fluid-supply writing implement according to claim 9, wherein the communication tubes penetrate the inside of the low density portion, and the forward end portions of the communication tubes and the rear end portion of the pentip are located in the high density portion.

11. The direct-fluid-supply writing implement according to claim 9, wherein when the forward end portions of the communication tubes are inserted into the ink occlusion body from the rear end, the front end portions of the communication tubes push and compress the inside of the ink occlusion body forward, so that the high density portion is formed inside the ink occlusion body in the vicinity of the front end portions of the communication tubes.

12. The direct-fluid-supply writing implement according to claim 9, wherein the high density portion is formed when an outside of the ink occlusion body is pushed and compressed inward in a radial direction.

13. The direct-fluid-supply writing implement according to claim 9, wherein the high density portion is formed when a front end face of the ink occlusion body is pushed and compressed backward.

14. The direct-fluid-supply writing implement according to claim 9, wherein the ink occlusion body includes a first ink occlusion body, of which density is set at a high value, and a second ink occlusion body, of which density is set at a low value, wherein the first ink occlusion body forms the high density portion and the second ink occlusion body forms the low density portion.

15. The direct-fluid-supply writing implement according to claim 9, wherein a front end opening portion of the ink tank before the opening portion is opened is closed with a plug body, a connection tube is protruded backward from a rear face of the partition wall, the connection tube is attached to the inside of the front end opening portion of the ink tank, the connection tube pushes the plug body so as to open the ink tank, the communication tube protruded backward from the rear face of the partition wall is located inside the connection tube, and the rear end of the communication tube protruded backward from the rear face of the partition wall is located at a position in a front portion of the rear end of the connection tube, or alternatively, a position in an axial direction of the rear end portion of the communication tube protruded backward from the rear face of the partition wall and a position in the axial direction of the rear end portion of the connection tube substantially coincide with each other.

16. The direct-fluid-supply writing implement according to claim 15, wherein a protruding piece for pushing one side of the plug body at the time of opening the ink tank is arranged on one side at the rear of the connection tube, and an outer face of the communication tube protruded backward from the rear face of the partition wall and an inner face of the protruding piece are made to come close to each other.

17. A direct-fluid-supply writing implement comprising:

a pentip;

an ink occlusion body connected to a rear end of the pentip;

an ink tank that directly stores ink and is arranged at the rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, a connection tube attached to the front end opening portion of the ink tank is protruded backward with respect to the rear face of the partition wall, and flow passages are provided in the communication tubes so as to penetrate the partition wall;

wherein the ink occlusion body includes a high density portion and a low density portion connected to a rear portion of the high density portion, and front end portions of the communication tubes and a rear end portion of the pentip are located in the high density portion.

18. A direct-fluid-supply writing implement comprising:

a pentip;

an ink occlusion body connected to a rear end of the pentip;

an ink tank that directly stores ink, and is arranged at the rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, a contact wall portion that comes into contact with a portion of the rear end face of the ink occlusion body is provided on a front face of the partition wall, when the contact wall portion and the rear end face of the ink occlusion body are contacted with each other, a gap that communicates with an ambient air is formed between the rear end face of the ink occlusion body and the front face of the partition wall, the contact wall portion is connected to a base portion of each communication tube and the front face of the partition wall, and the contact wall portion connects the base portions of the communication tubes to each other.

19. The direct-fluid-supply writing implement according to claim 18, wherein the contact wall portion is made of a plate-shaped rib protruding in an axial direction.

20. The direct-fluid-supply writing implement according to claim 18, wherein the ink occlusion body includes a high density portion and a low density portion connected to a rear portion of the high density portion, and front end portions of the communication tubes and a rear end portion of the pentip are located in the high density portion.

21. The direct-fluid-supply writing implement according to claim 18, wherein a connection tube attached to the front end opening portion of the ink tank is protruded backward from the rear face of the partition wall, and the partition wall, the communication tubes, the contact wall portion and the connection tube are integrated with each other.

22. The direct-fluid-supply writing implement according to claim 18, wherein an attaching cylindrical portion surrounding a base portion of each communication tube or a base portion of the connection tube is provided so as to be integrated with the partition wall, and an outer face of the attaching cylindrical portion is fixed onto an inner face of a barrel.

23. A direct-fluid-supply writing implement comprising:

a pentip;

an ink occlusion body connected to a rear end of the pentip;

an ink tank that directly stores ink and is arranged at the rear of the ink occlusion body;

a plurality of communication tubes that connects the ink tank to the ink occlusion body; and a partition wall provided between the ink occlusion body and the ink tank, wherein forward end portions of the communication tubes are protruded forward from a front face of the partition wall, and are located inside the ink occlusion body, a connection tube attached to the front end opening portion of the ink tank is protruded backward with respect to the rear face of the partition wall, and flow passages are provided in the communication tubes so as to penetrate the partition wall;

wherein at least one of the communication tubes that is protruded backward is provided within the connection tube.

24. The direct-fluid-supply writing implement according to claim 23, wherein the flow passages of the communication tubes penetrate portions except for an axial center of the partition wall.

25. The direct-fluid-supply writing implement according to claim 23, wherein the partition wall, the communication tubes and the connection tube are integrated into one body.

26. The direct-fluid-supply writing implement according to claim 23, wherein an attaching cylindrical portion that surrounds a base portion of each communication tube or a base portion of the connection tube is integrally formed on the partition wall, and an outer face of the attaching cylindrical portion is fixed onto an inner face of a barrel.

* * * * *